US011344469B2

(12) United States Patent
Zhijian

(10) Patent No.: US 11,344,469 B2
(45) Date of Patent: May 31, 2022

(54) BACKPACK, BAG OR BABY CARRIER WITH REMOVABLE MASSAGE PANEL

(71) Applicant: Li Zhijian, Fujian (CN)

(72) Inventor: Li Zhijian, Fujian (CN)

( * ) Notice: Subject to any disclaimer, the term of this patent is extended or adjusted under 35 U.S.C. 154(b) by 173 days.

(21) Appl. No.: 16/850,043

(22) Filed: Apr. 16, 2020

(65) Prior Publication Data

US 2020/0330317 A1 Oct. 22, 2020

Related U.S. Application Data

(63) Continuation-in-part of application No. 16/693,452, filed on Nov. 25, 2019, now Pat. No. 10,888,494, and a continuation-in-part of application No. 16/693,259, filed on Nov. 23, 2019.

(60) Provisional application No. 62/854,261, filed on May 29, 2019, provisional application No. 62/834,551, filed on Apr. 16, 2019.

(51) Int. Cl.

| | |
|---|---|
| ***A45F 3/04*** | (2006.01) |
| ***A61H 15/00*** | (2006.01) |
| ***A47D 13/02*** | (2006.01) |
| ***A45F 3/14*** | (2006.01) |

(52) U.S. Cl.

CPC ..... *A61H 15/0078* (2013.01); *A45F 3/047* (2013.01); *A45F 3/14* (2013.01); *A47D 13/02* (2013.01); *A61H 2201/0157* (2013.01); *A61H 2201/1215* (2013.01); *A61H 2201/1238* (2013.01); *A61H 2201/1626* (2013.01); *A61H 2201/1652* (2013.01)

(58) Field of Classification Search

CPC ..... A61H 15/0078; A61H 2201/0157; A61H 2201/1215; A61H 2201/138; A61H 2201/1626; A61H 2201/1652; A45F 3/047; A45F 3/14; A47D 13/02

See application file for complete search history.

(56) References Cited

U.S. PATENT DOCUMENTS

| | | | | |
|---|---|---|---|---|
| 3,957,184 | A | 5/1976 | Shurman | |
| 6,816,760 | B1 | 11/2004 | Namaky | |
| 6,870,089 | B1 | 3/2005 | Gray | |
| 9,144,255 | B1 | 9/2015 | Perciballi | |
| 9,780,344 | B2 * | 10/2017 | Thiel | H01M 50/231 |
| 10,288,384 | B2 * | 5/2019 | Kinnings | A45F 3/12 |
| 10,561,225 | B2 | 2/2020 | Parekh | |
| 10,616,534 | B2 | 4/2020 | Thiel | |
| 2002/0198031 | A1 | 12/2002 | Holmes | |
| 2003/0062391 | A1 | 4/2003 | Mitchell | |

(Continued)

FOREIGN PATENT DOCUMENTS

KR 2014132850 A 11/2014

*Primary Examiner* — Brian D Nash

(74) *Attorney, Agent, or Firm* — Jennifer Meredith, Esq.; Meredith Attorneys, PLLC

(57) ABSTRACT

A backpack, bag, baby carrier with removable massage panel, comprising a body and a back panel with at least one shoulder strap, wherein the back panel has an upper portion with a top part and a portion of the top edge of the top part is connected to the shoulder strap, a bottom area of the top part is connected to the back panel of the body by at least one adjustable band, wherein the top part has at least one massager apparatus, wherein the top part is a substantially rigid material that is at least 1 mm thick, wherein the massager apparatus has at least one massage head that is covered by a foam material.

27 Claims, 28 Drawing Sheets

(56) References Cited

U.S. PATENT DOCUMENTS

| | | | | |
|---|---|---|---|---|
| 2003/0168488 | A1 | 9/2003 | Ho | |
| 2005/0020184 | A1 | 1/2005 | Izcoa | |
| 2005/0140331 | A1 | 6/2005 | McQuade | |
| 2006/0113343 | A1 | 6/2006 | Chang | |
| 2007/0297149 | A1 | 12/2007 | Richardson | |
| 2008/0011799 | A1 | 1/2008 | Chang | |
| 2008/0125164 | A1 | 5/2008 | Singh | |
| 2008/0210728 | A1 | 9/2008 | Bihn | |
| 2009/0061926 | A1 | 3/2009 | Lee | |
| 2009/0201671 | A1 | 8/2009 | Huntley | |
| 2009/0224722 | A1 | 9/2009 | Causey | |
| 2009/0276089 | A1 | 11/2009 | Bartholomew | |
| 2010/0155447 | A1* | 6/2010 | Zheng | A45F 3/047 224/576 |
| 2011/0110514 | A1 | 5/2011 | Gustavsson | |
| 2012/0262117 | A1 | 10/2012 | Ferber | |
| 2012/0299528 | A1 | 11/2012 | Scarmozzino | |
| 2013/0026726 | A1 | 1/2013 | Thomas | |
| 2013/0162389 | A1 | 6/2013 | Crucs | |
| 2013/0214931 | A1 | 8/2013 | Chia | |
| 2013/0249673 | A1 | 9/2013 | Ferrari | |
| 2014/0002239 | A1 | 1/2014 | Rayner | |
| 2014/0061273 | A1 | 3/2014 | Bullivant | |
| 2014/0171132 | A1 | 6/2014 | Ziemianska | |
| 2015/0296644 | A1 | 10/2015 | Chin | |
| 2015/0326044 | A1 | 11/2015 | Ashley | |
| 2015/0359127 | A1 | 12/2015 | Daoura | |
| 2015/0366333 | A1 | 12/2015 | Zhijian | |
| 2016/0112004 | A1 | 4/2016 | Thiel | |
| 2016/0118634 | A1 | 4/2016 | Thiel | |
| 2016/0141904 | A1 | 5/2016 | Zhijian | |
| 2017/0027806 | A1 | 2/2017 | Lin | |
| 2017/0196347 | A1 | 7/2017 | Sawhney | |
| 2019/0343266 | A1 | 11/2019 | Parekh | |
| 2019/0374012 | A1 | 12/2019 | Chang | |
| 2020/0222274 | A1* | 7/2020 | Zhijian | A45C 13/001 |
| 2020/0330316 | A1* | 10/2020 | Zhijian | A61H 15/00 |
| 2021/0137784 | A1* | 5/2021 | Zhijian | A61H 1/00 |

* cited by examiner 182
192
180
190
188
186
166
184
194
164

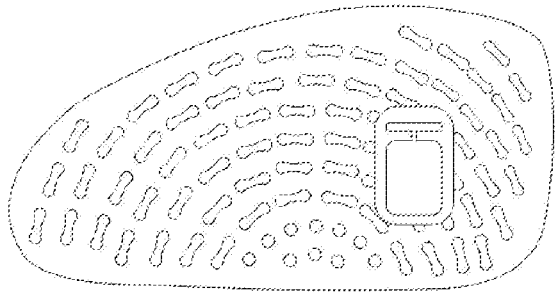
FIGURE 32
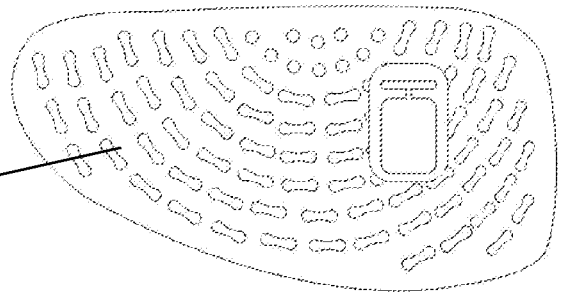
302
FIGURE 31
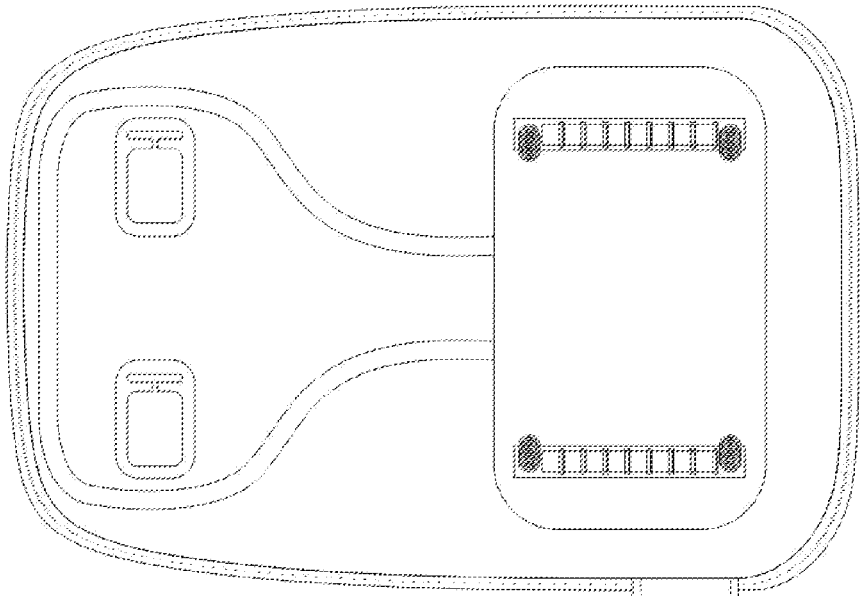
FIGURE 30
300
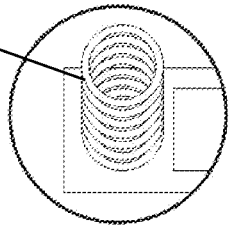

350

BACKPACK, BAG OR BABY CARRIER WITH REMOVABLE MASSAGE PANEL

This application claims priority to provisional patent application 62/834,551 filed Apr. 16, 2019. This application also claims priority to patent application Ser. No. 16/693,259 filed Nov. 23, 2019, which in turn claims priority to patent application 62/834,551 and Chinese patent application 20190028229.9 filed Jan. 11, 2019. This application also claims priority to patent application Ser. No. 16/693,452 filed Nov. 25, 2019, which in turn claims priority to patent application Ser. No. 16/693,259 filed Nov. 23, 2019. This application claims priority to provisional patent application 62/854,261 filed May 29, 2019. Each of these applications (62/834,551, Ser. No. 16/693,259, Chinese patent application 20190028229.9, Ser. No. 16/693,452 and 62/854,261) are incorporated herein by reference.

The invention provides a massage backpack, a bag or a baby carrier which can be adjusted to massage different positions on your back. The massage part can also be released so that you are able to put away your backpack and sit down on a chair for a massage. This is envisioned to have many benefits. For example, when traveling, you can put away your bag and be massaged while on an airplane, train or car. Similarly, a person going to work, may want to use the massager while at work (detached from the backpack) or while walking through a city (with the backpack attached). Any reference made to a backpack would similarly apply to a bag or baby carrier. Another example may be that they want to detach the massager and place it under their feet to massage the bottom of the feet.

It is also envisioned that there are many advantages to having a panel that may be adjusted and may be removed. For example, the user may have a specific part of their back they like to have massaged. They may also want to massage one section of the back for a certain amount of time, then move the massager and massage a different section of the back.

BRIEF DESCRIPTION OF THE INVENTION

According to embodiment of the present invention, a backpack, bag or baby carrier is provided comprising a body and a back panel with at least one shoulder strap, wherein the back panel has an upper portion with a top part and a portion of the top edge of the top part is connected to the shoulder strap, a bottom area of the top part is connected to the back panel of the body by at least one adjustable band, wherein the top part has at least one massager apparatus, wherein the top part is a substantially rigid material that is at least 1 mm thick and wherein the massager apparatus has at least one massage head that is covered by a foam material.

According to another embodiment of the present invention, a backpack, bag, or baby carrier is provided with a removable massage panel, comprising a body), at least one shoulder strap, and a removable panel with at least one massage apparatus on it, wherein the removable panel is at least 1 mm thick of substantially rigid material, wherein the massager apparatus has at least one massage head which is covered by a foam cover.

BRIEF DESCRIPTION OF THE FIGURES

FIG. 30 depicts ergonomic accessories according to the present invention;

FIG. 31 depicts ergonomic accessories according to the present invention;

FIG. 32 depicts ergonomic accessories according to the present invention;

DETAILED DESCRIPTION OF THE INVENTION

Figure 1:
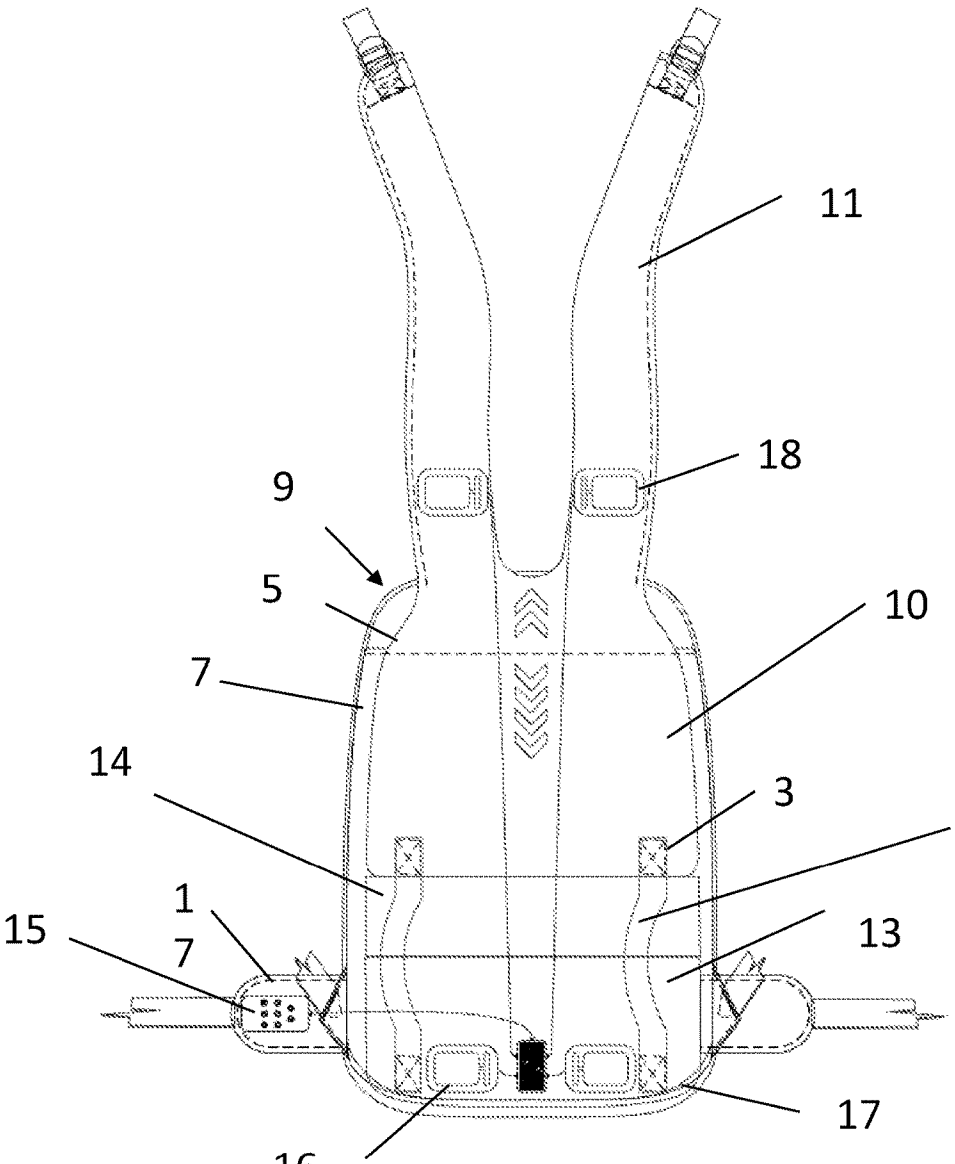
FIG. 1 depicts a backpack according to the present invention.
Figure 4:
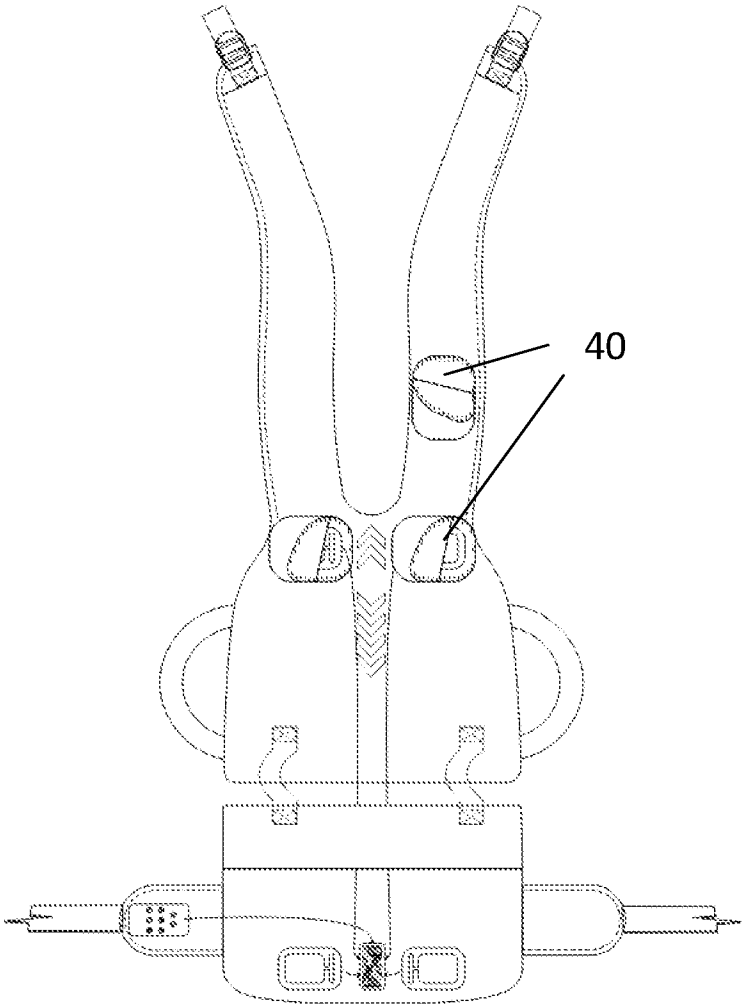
FIG. 4 depicts a removable massage panel removed from the backpack according to the present invention.

As shown in FIG. 1, the present invention provides a backpack, bag or baby carrier with a removable massage panel having a body (9) with a back panel (7) and at least one shoulder strap (11). The body (9) refers to the backpack, bag or baby carrier that the removable massage panel is attached to. The example shown has two shoulder straps, but it envisioned there could be a single shoulder strap, as in a cross body bag. The back panel has an upper portion with a top part (10) and a portion of the top edge (5) of the top part (10) is connected to the shoulder strap (11), a bottom area (3) of the top part (10) is connected to the back panel (7) of the body (9) by at least one adjustable band (12), wherein the top part (10) has at least one massager apparatus (18). The top part is at least 1 mm thick of substantially rigid material. Examples of the substantially rigid materials may be: Polyethylene board (PE), or cardboard, or Polypropylene (PP) board, or polyvinyl chloride (PVC) board, or Acrylonitrile Butadiene Styrene (ABS) board, Thermoplastic Elastomer (TPE), or Ethylene Vinyl Acetate (EVA), or Expandable Polyethylene (EPE), etc. covered by body fabric; or can be foam materials as below. The material should be at least 1 mm thick to keep the top part in shape and not easy to bend. This is important to select correct different combination of materials in suitable thickness, to make the panels with a degree of thickness and a little stiff but still can comfort the users back The massager apparatus has at least one massage head (e.g. 16 and 18). It is also typically covered by a foam material (40), as shown in FIG. 4. The foam material may be Ethylene-vinyl acetate foam, Poly urethane foam, butadiene rubber foam, vinyl acetate foam, Expandable Polyethylene, Polyethylene, Crosslinked polyethylene foaming, Electron radiation crosslinked polyethylene foaming, or any other foamy material. FIG. 1 depicts an embodiment in which there is a lower portion (13) with at least one massage head (16) that is fixed on a lower part (17) of the back panel of the body.

Figure 2:
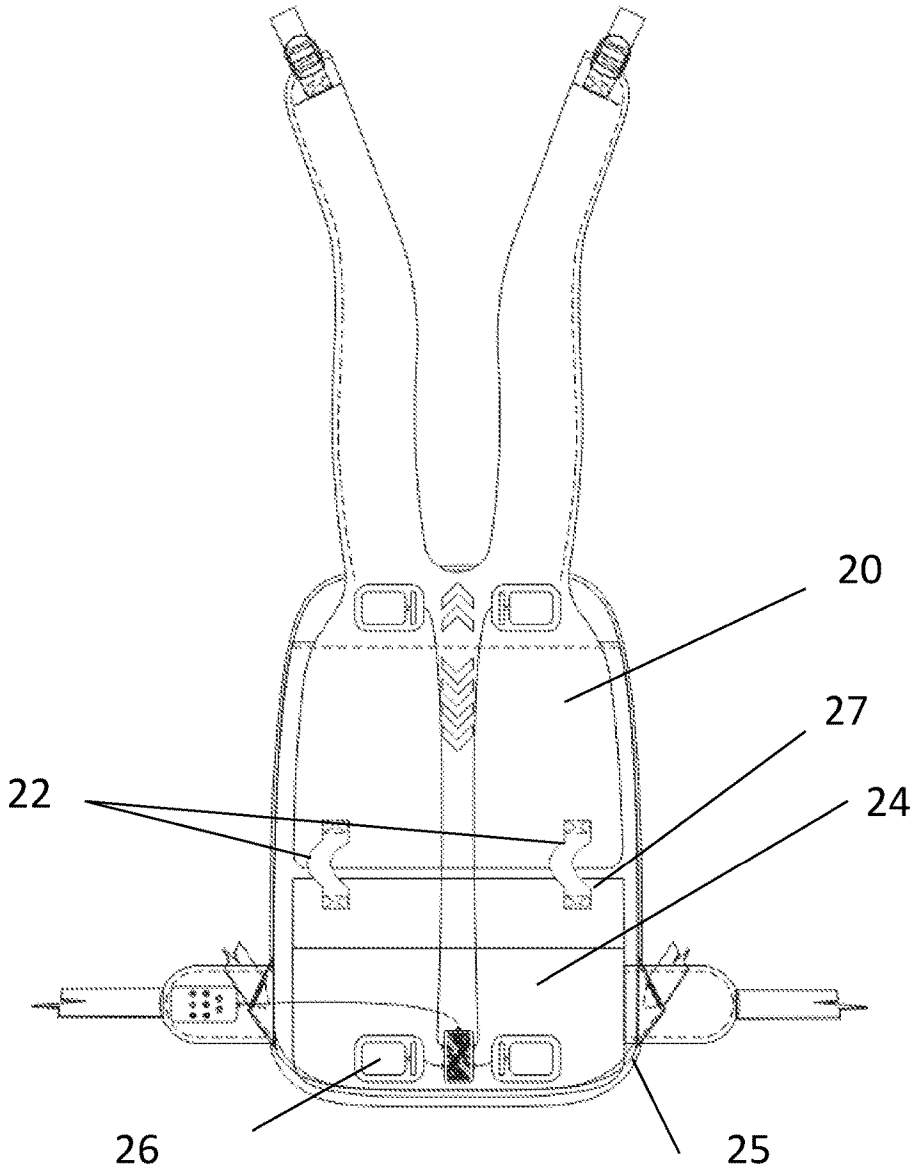
FIG. 2 depicts a backpack according to the present invention.

FIG. 2 depicts an embodiment in which the back panel of the body has a lower portion that may be removable. The at least one adjustable band (22) can be at the bottom area of the top part (20) and move up the upper part (27) of the lower portion (24) to adjust the location of the massage head (26). The top part (20) may also be removably attached to the upper portion (25) of the back panel of the body. The lower part (24) may also be removably attached to the lower portion of the back panel of the body. The lower part may be removably attached by a material selected from the group consisting of a zipper, buckle, magic band, hook and loop, button, snap and hook. The adjustable band may be fixed on the bottom portion of the top part and the lower part and have at least one detachable accessory, wherein the detachable accessory is selected from the group consisting of webbing, ribbon, zipper, buckle, magic band, velcro, button, snap and hook.

Figure 3:
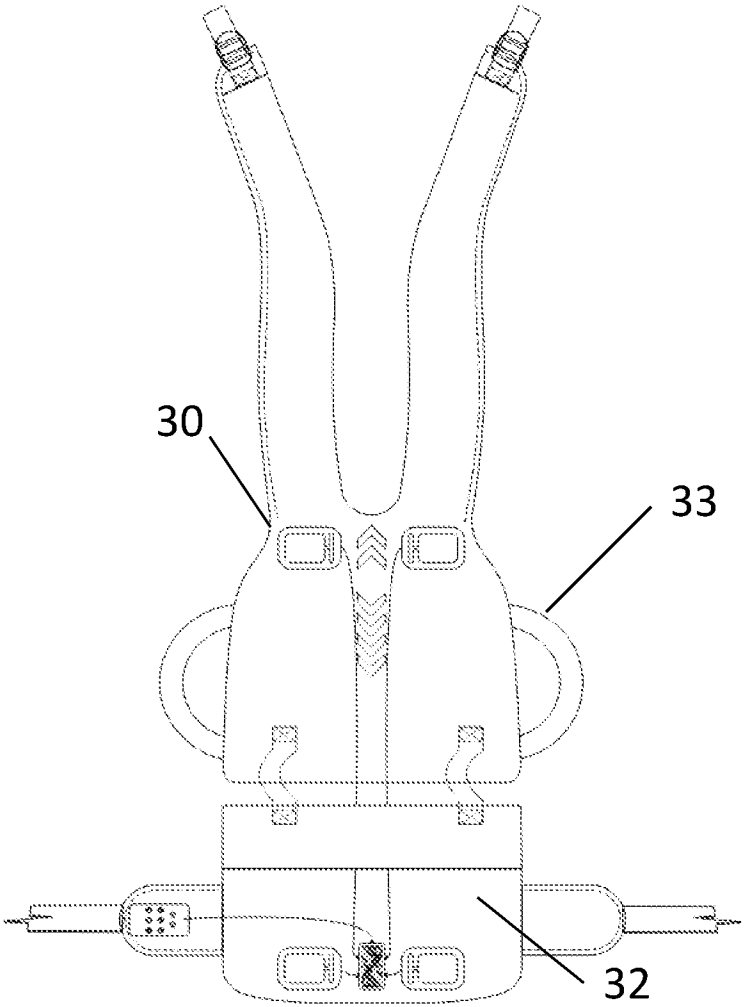
FIG. 3 depicts a removable massage panel removed from the backpack according to the present invention.
Figure 6:
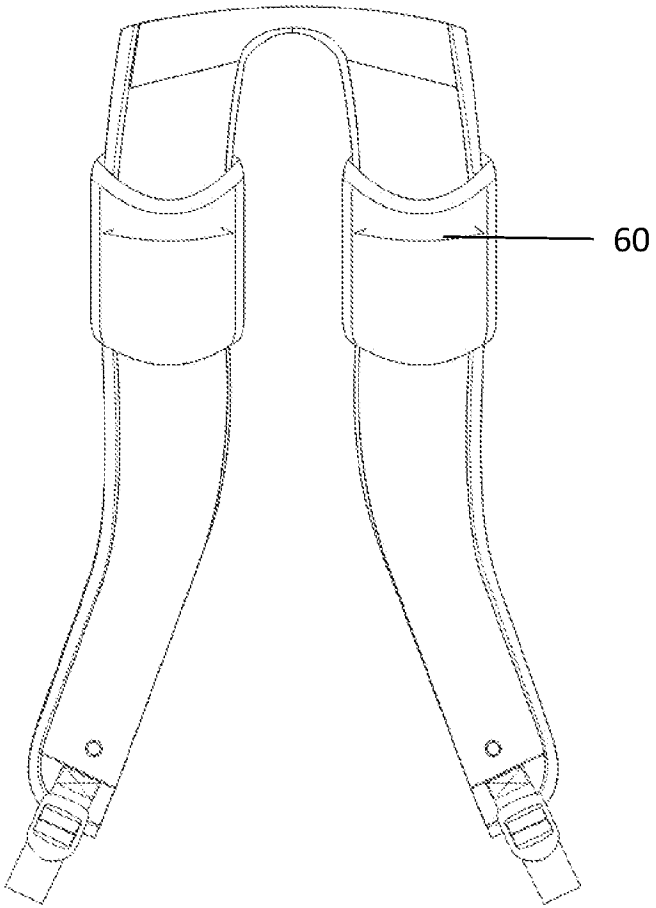
FIG. 6 depicts a protective cover to cover the massage head having a zipper according to the present invention.
Figure 5:
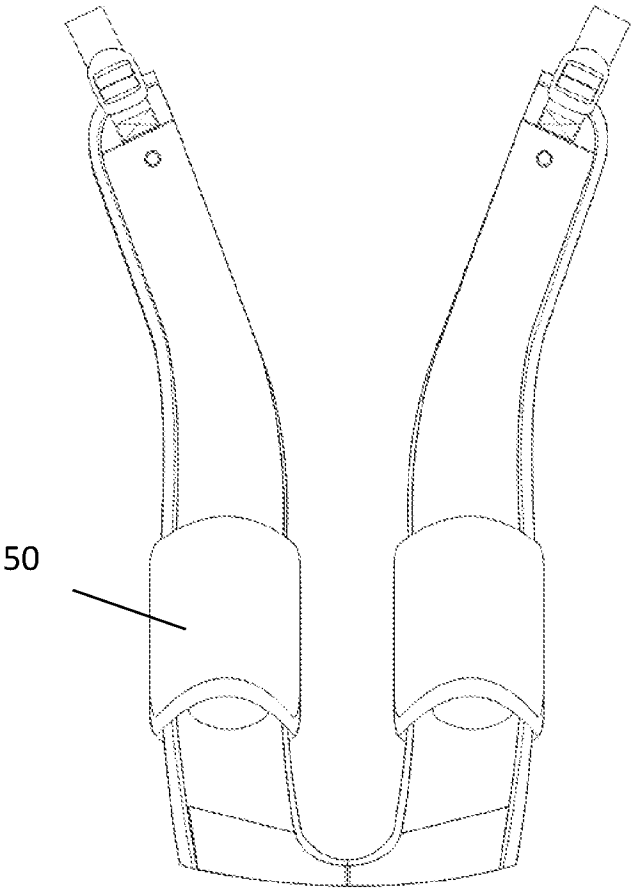
FIG. 5 depicts a protective cover to cover the massage head according to the present invention.
Figure 7:
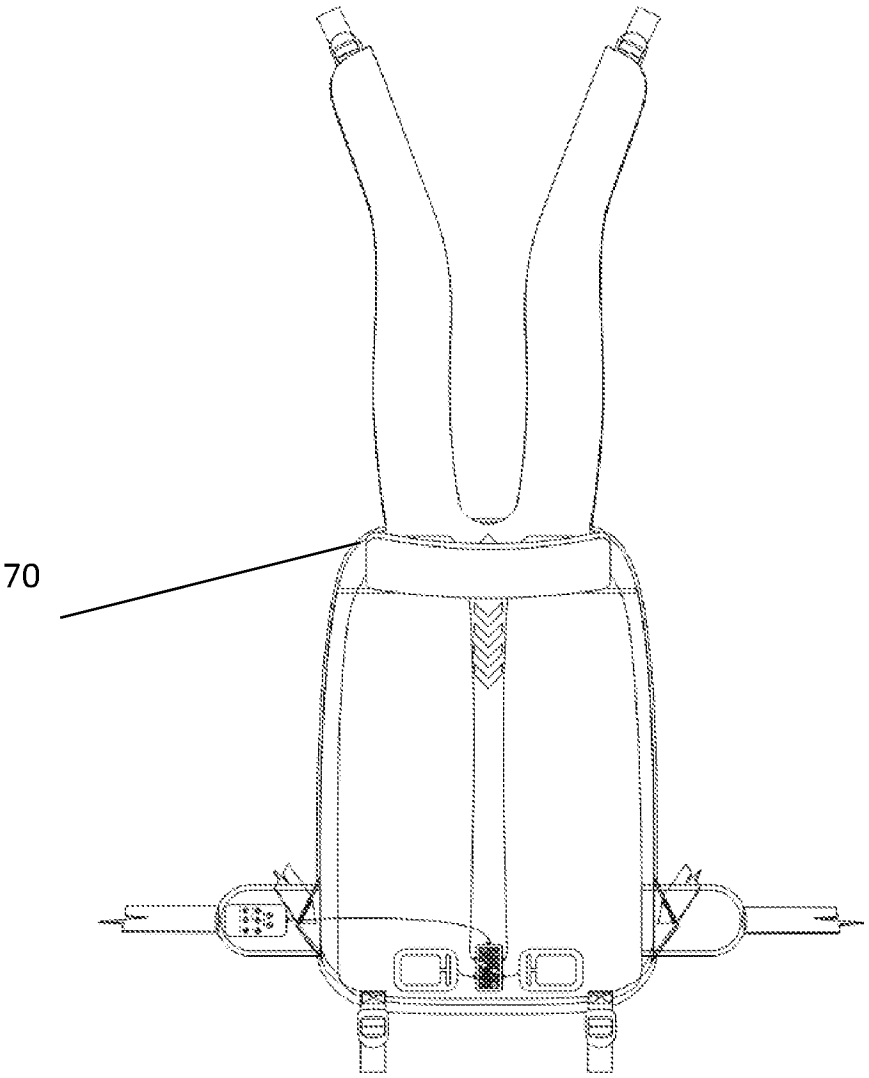
FIG. 7 depicts another example of a protective cover according to the present invention.

FIGS. 3 and 4 depicts the top part (30) and the lower part (32) may be removed from the back, bag or baby carrier body and used separately. For example, a person may want to carry their bag to work and use the massager to massage their back for a subway ride. Upon arriving at work, they want to use the massager in their chair. And there's a least an adjustable band (33) on the removable panel for attaching to a chair or something else. But they can not sit in their chair with a backpack on. So, they remove the massage panel from the bag and are able to use the massage portion. Similarly, a person may place the massage panel on the ground and massage their feet. This would not be possible with the massage panel attached to the bag. FIGS. 5 and 6 depict that there may be a protective cover (50), to cover the massage head when the massage is not operating. The protective cover may be turned and attached to another position of the body. The protective cover may also be removable and have a pocket (60). FIG. 7 depicts another example of a protective cover (70).

Figure 8:
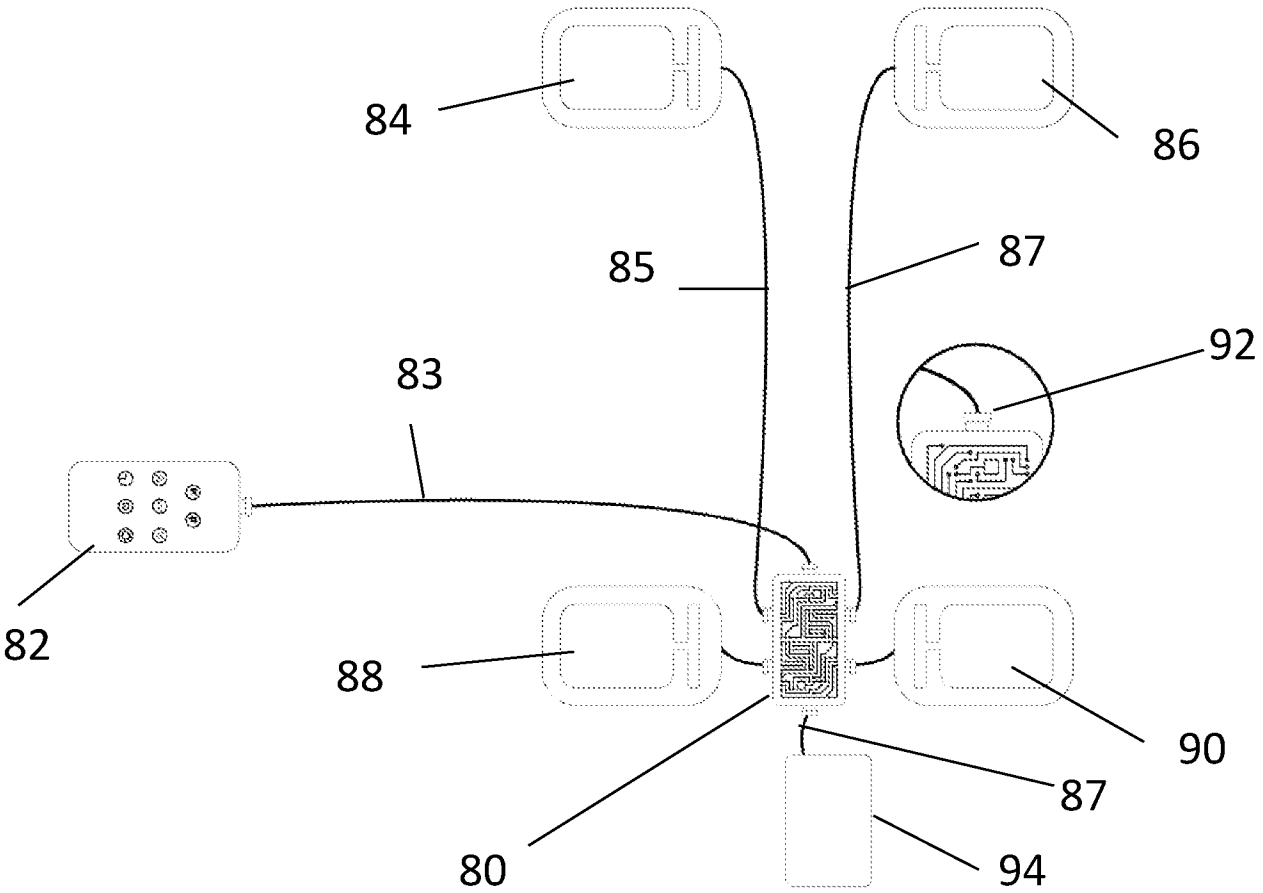
FIG. 8 depicts a massage apparatus according to the present invention.
Figure 11:
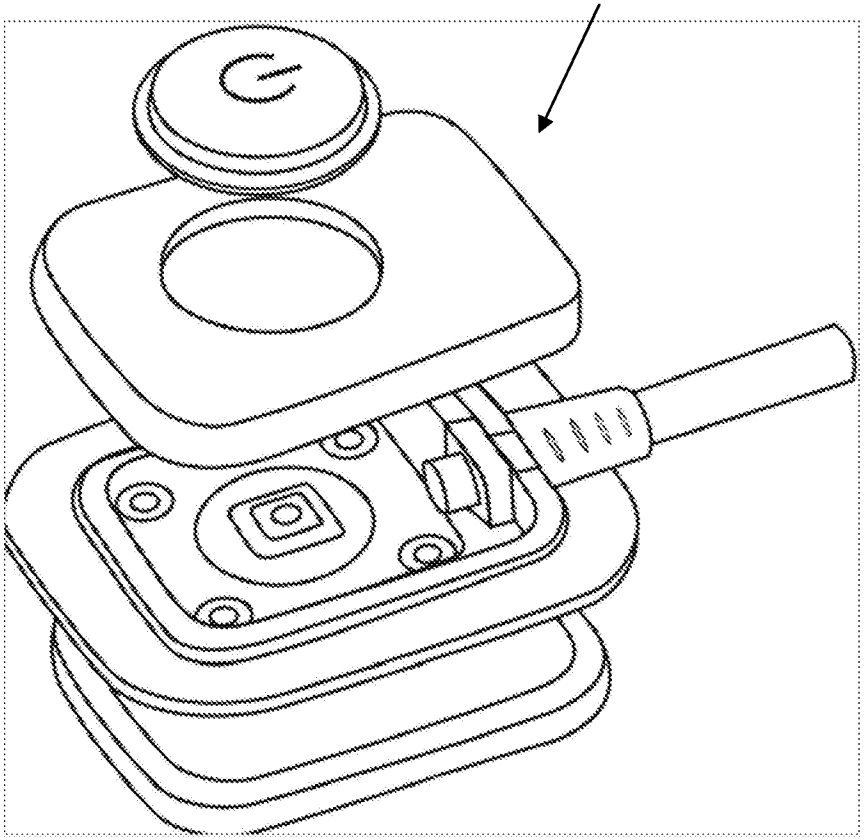
FIG. 11 depicts a wired solid function control board according to the present invention.
Figure 13:
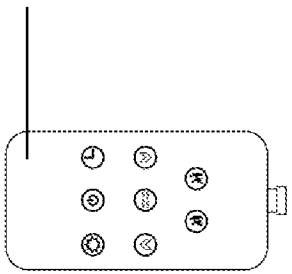
FIG. 13 depicts a wireless control according to the present invention.
Figure 12:
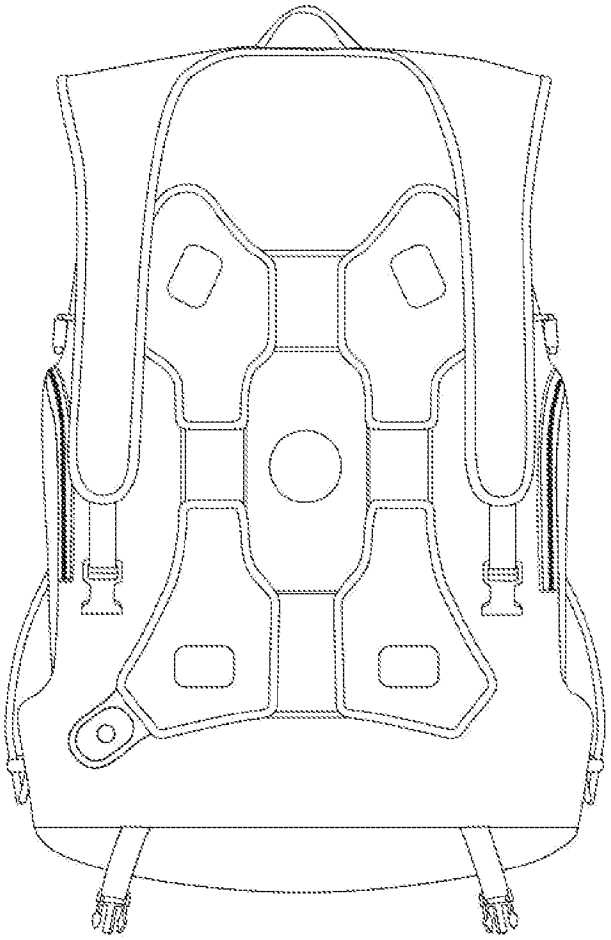
FIG. 12 depicts another example of a removable massage panel according to the present invention.

FIG. 8 depicts that the massage apparatus may have a control circuit (80) and a function control board (82) for controlling the massage apparatus (84, 86, 88 and 90). There may also be a battery (94) for powering the massage apparatus. The massage apparatus may have at least two cables (e.g. 85, 87) and each of the cables may have at least one fast connector (92) on at least one of the cables connecting the massage head and the control circuit, the massage head and the battery, the control circuit and the battery and the control circuit and function control board. The function control board can be a wired solid board (82) or a wireless connection controller. FIG. 11 depicts an exploded wired solid board (110). FIG. 13 depicts a wireless connection controller (130). FIG. 12 depicts a different shape of the removable massage panel.

Figure 10:
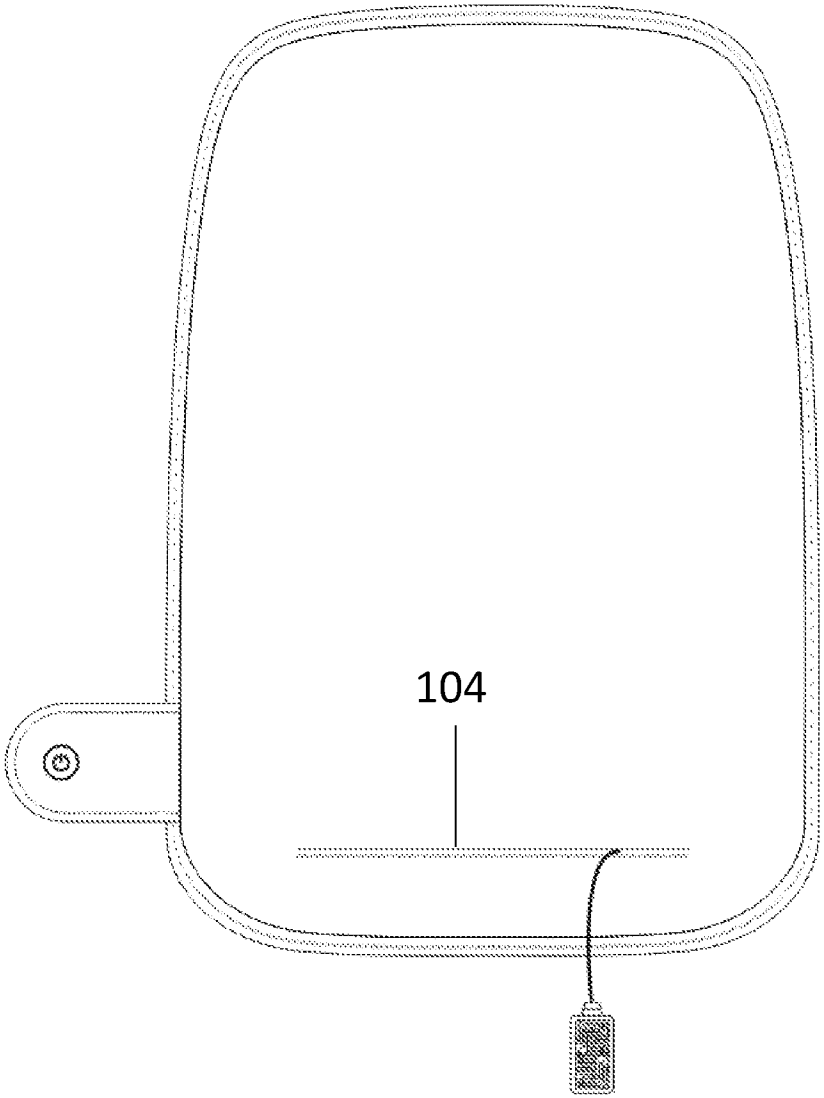
FIG. 10 depicts an opening according to the present invention.
Figure 9:
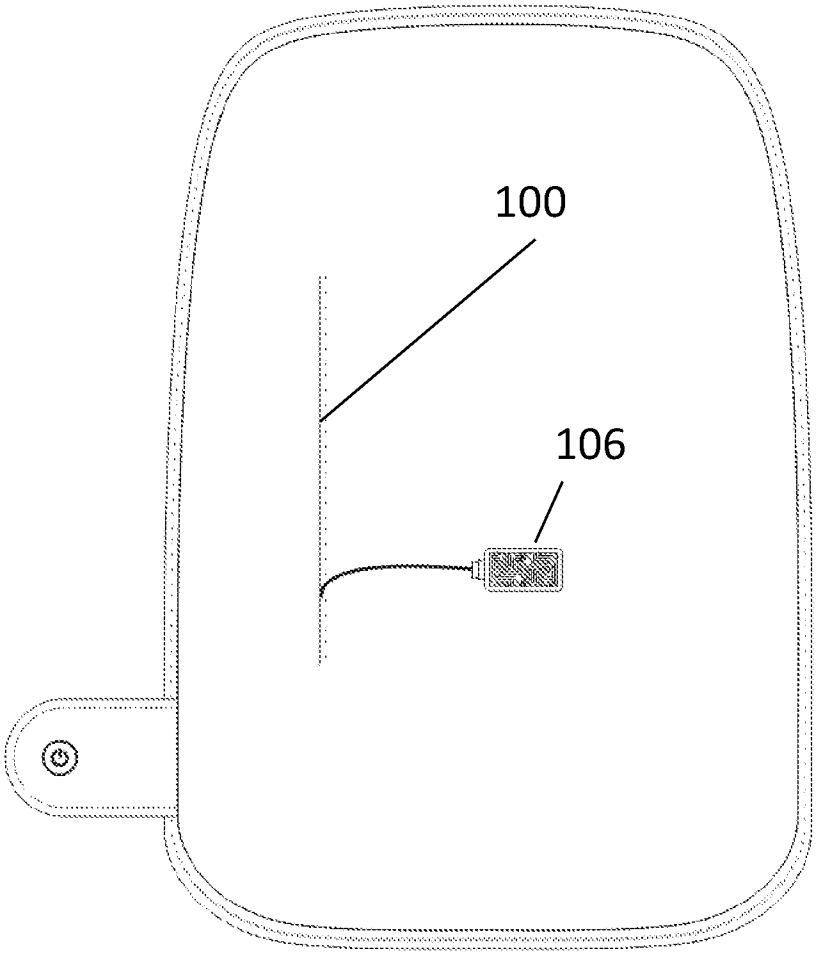
FIG. 9 depicts an opening according to the present invention.
Figure 14:
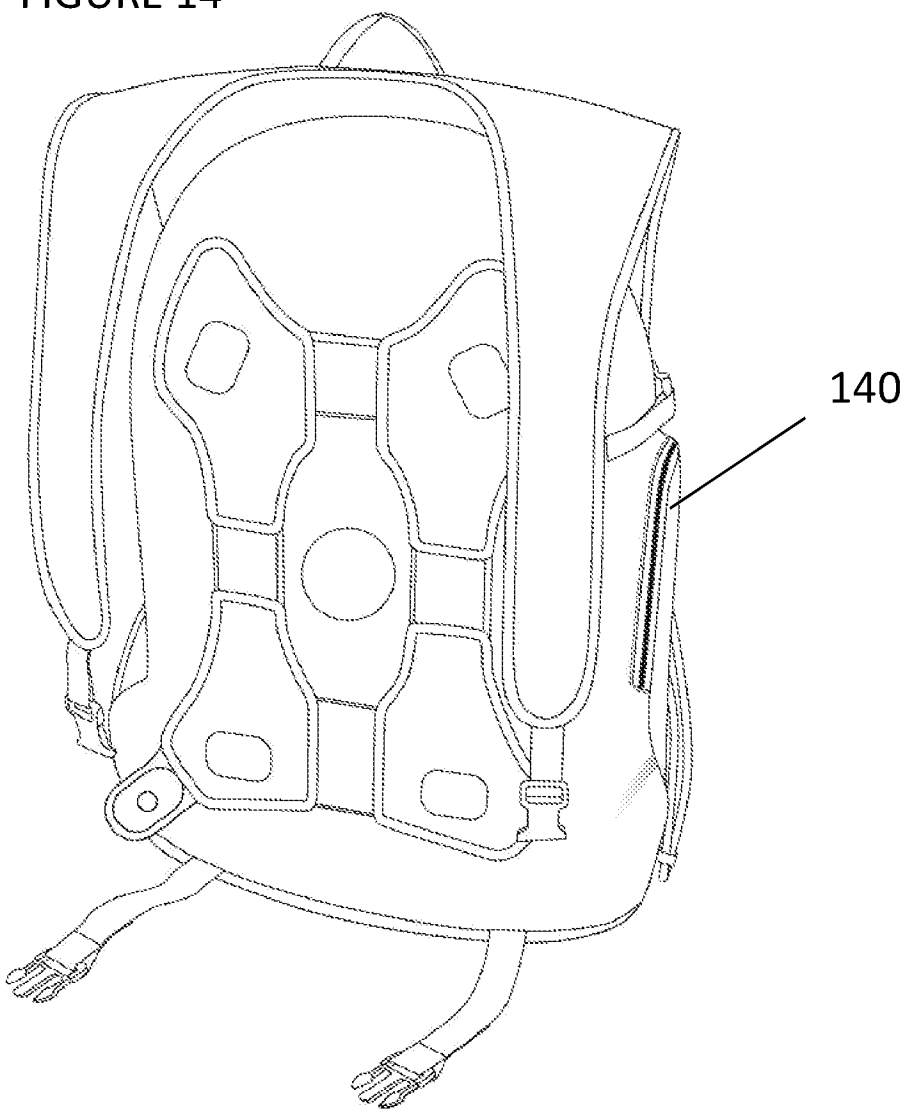
FIG. 14 depicts a pocket for battery storage according to the present invention.
Figure 15:
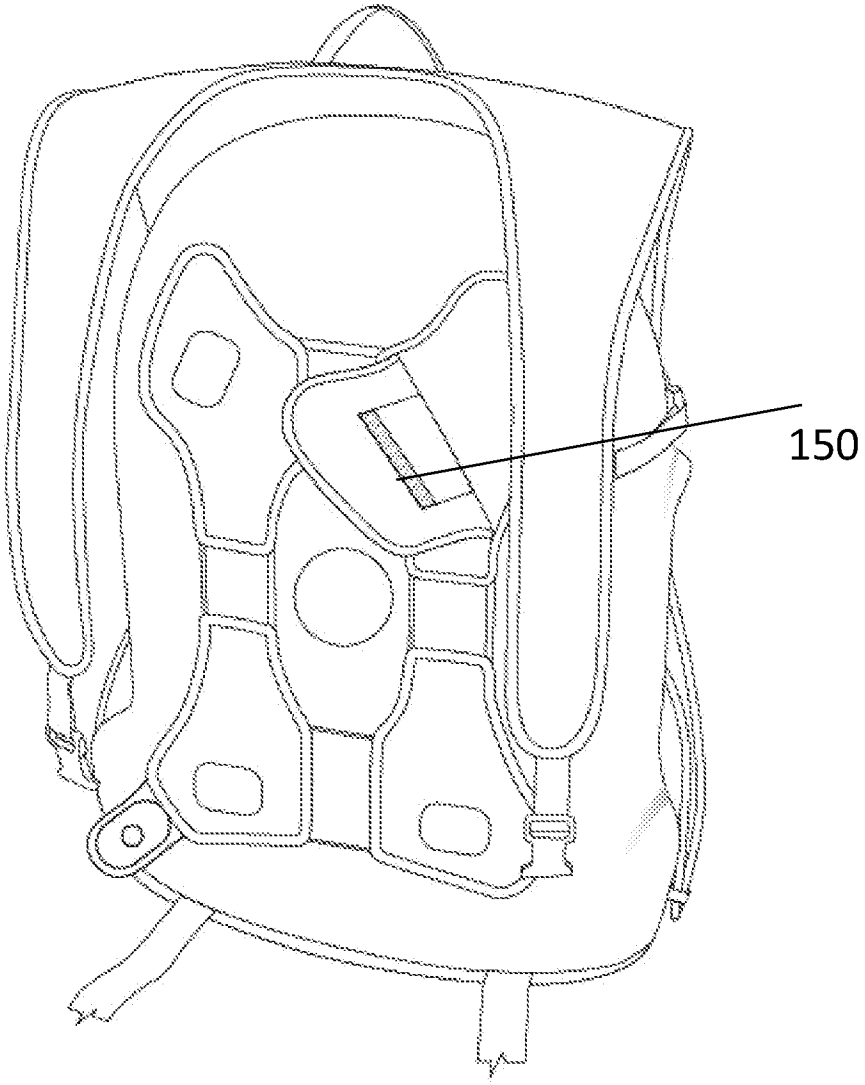
FIG. 15 depicts a second pocket for battery storage according to the present invention.

As shown in FIGS. 9 and 10, the backpack panel (102) of the body may have an opening (100 and 104). As can be seen the control circuit (106) may be fed through the opening (100 and 104). Then the opening will offer an easy way to replace the control circuit or any other part of this massage apparatus having any problem or damaged. FIG. 14 depicts a pocket (140) on a portion of the body storing a battery. FIG. 15 depicts a second pocket (150) for storing a battery.

Figures 16, 17, 18:
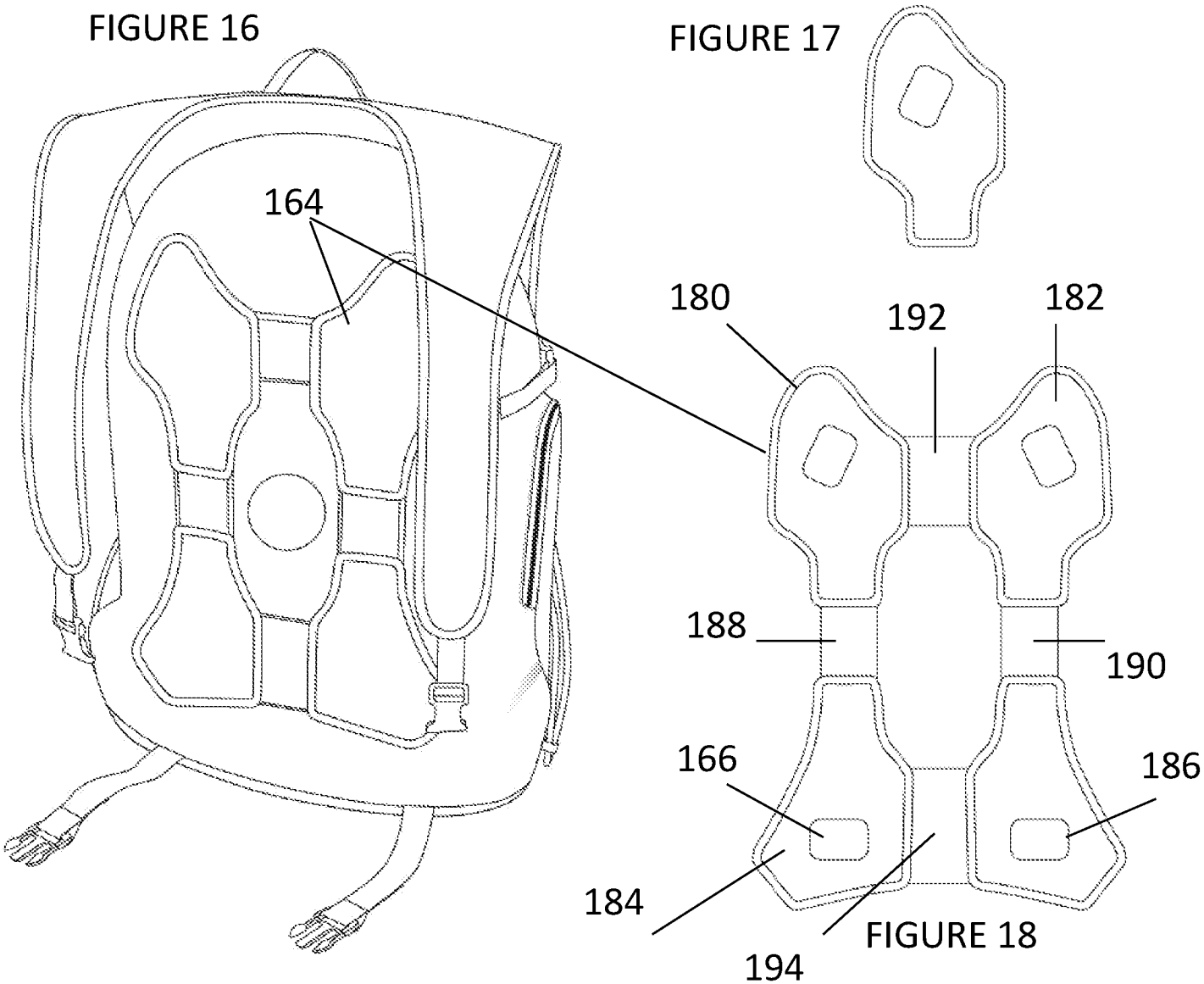
FIG. 16 depicts another example of a removable massage panel according to the present invention.
FIG. 17 depicts a portion of a removable massage panel according to the present invention.
FIG. 18 depicts the removable massage panel according to the present invention.

According to one embodiment, as depicted in FIGS. 16, 17 and 18, the backpack, bag, or baby carrier may have a removable massage panel, the backpack, bag or baby carrier having a body (160) with at least one shoulder strap (162), and a removable panel (164) with at least one massage apparatus on it (166). The removable panel should be at least 1 mm thick of substantially rigid material. The massager apparatus (155) has at least one massage head which is covered by a foam cover. FIGS. 16, 17 and 18 are intended to depict that the removable massage panel may be made up of connected parts each with a massage head on it. For example, top left panel (180) may be connected by a band (192) to top right panel (182) which may be connected by a band (190) to lower right panel (186) which may be connected by a band (194) to lower left panel (184) which may be connected to tope left panel (180).

Figure 20:
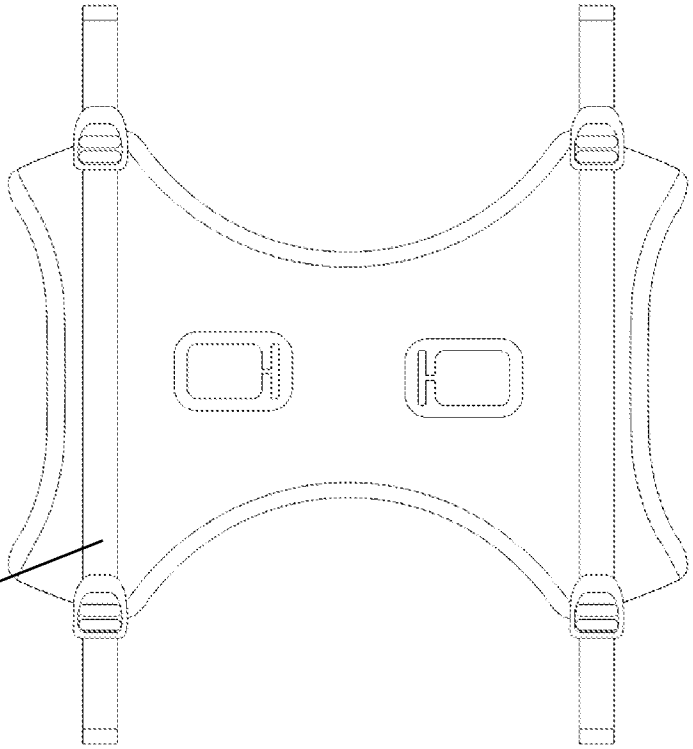
FIG. 20 depicts adjustable bands according to the present invention.
Figure 19:
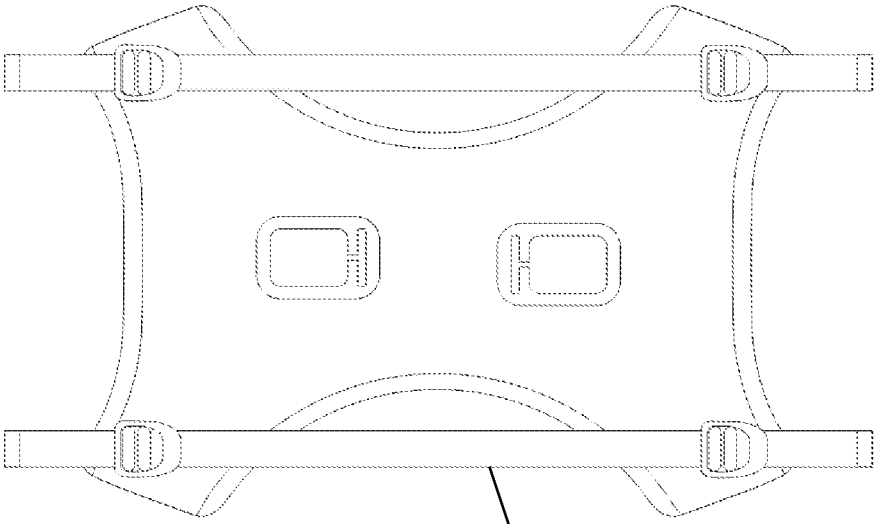
FIG. 19 depicts adjustable bands according to the present invention.
Figure 26:
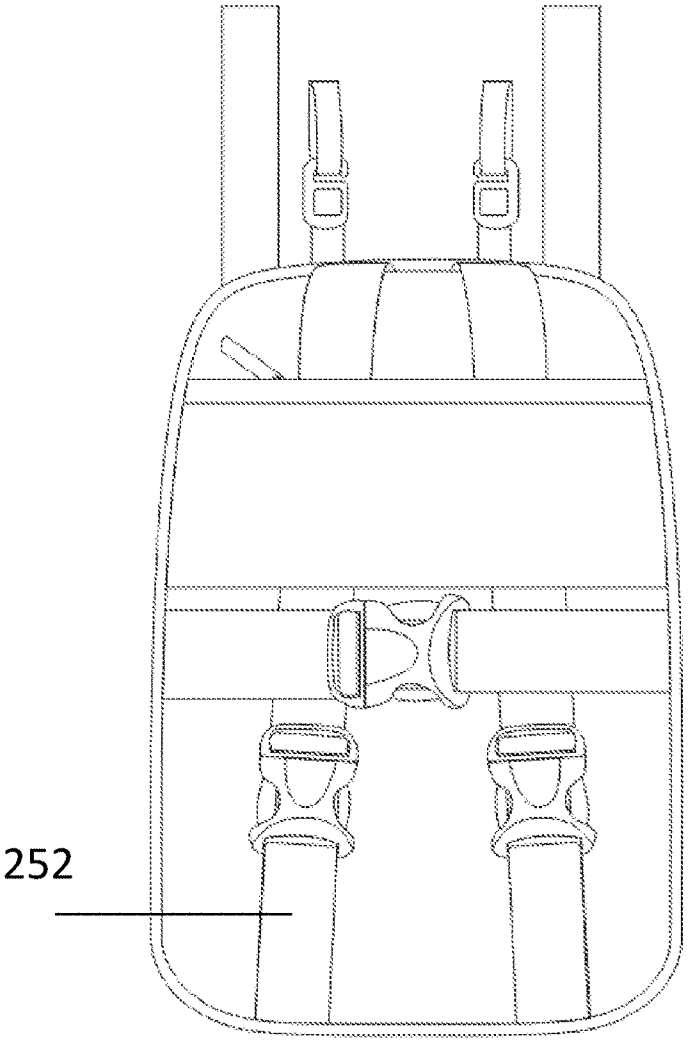
FIG. 26 depicts another example of the removable massage panel according to the present invention.
Figure 25:
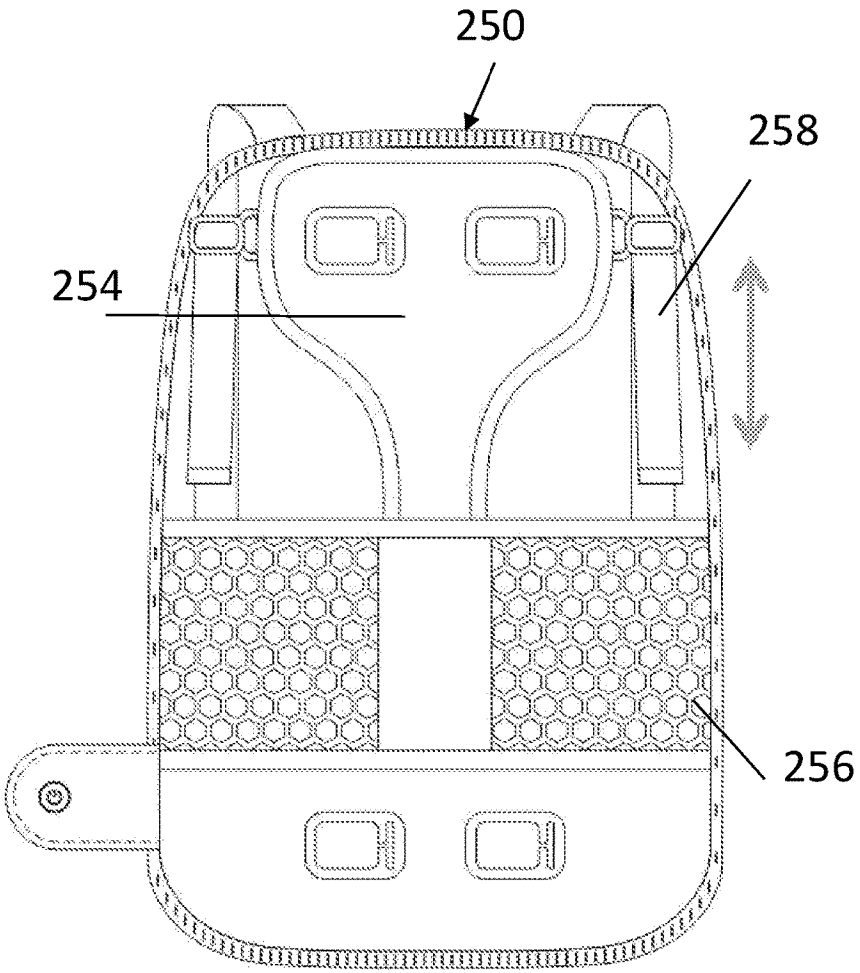
FIG. 25 depicts another example of the removable massage panel according to the present invention.
Figure 28:
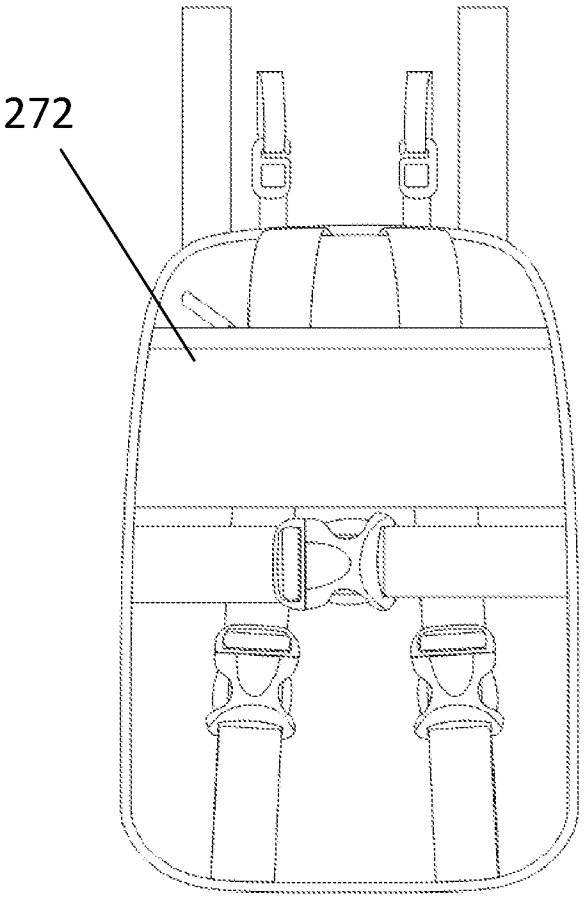
FIG. 28 depicts another example of the removable massage panel according to the present invention.
Figure 27:
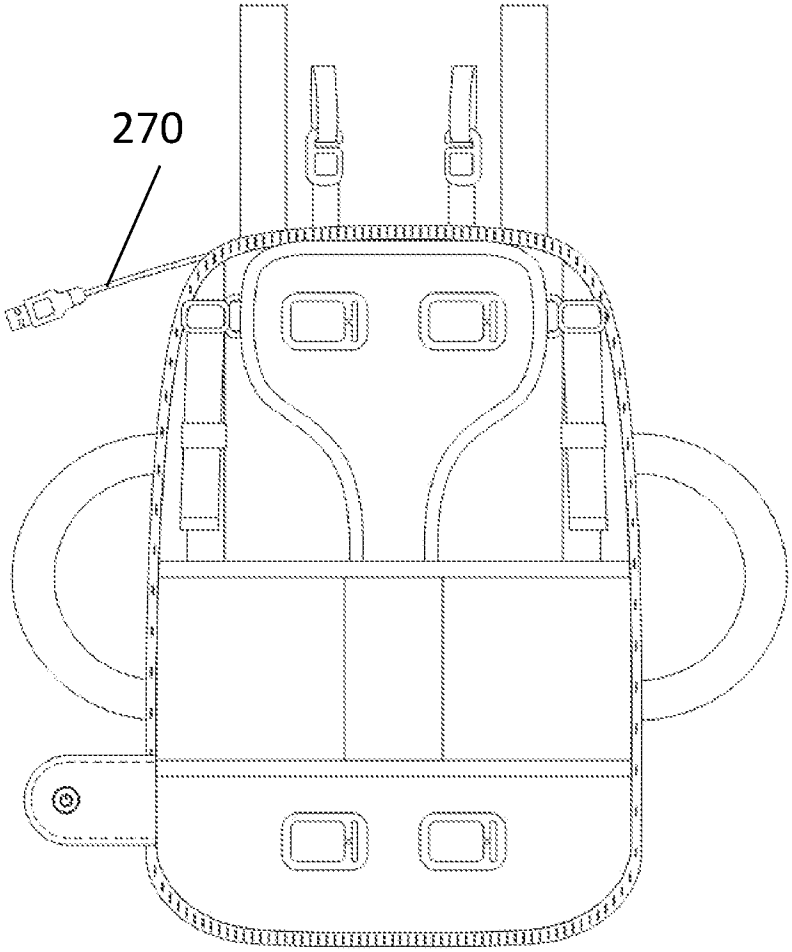
FIG. 27 depicts another example of the removable massage panel according to the present invention.
Figure 29:
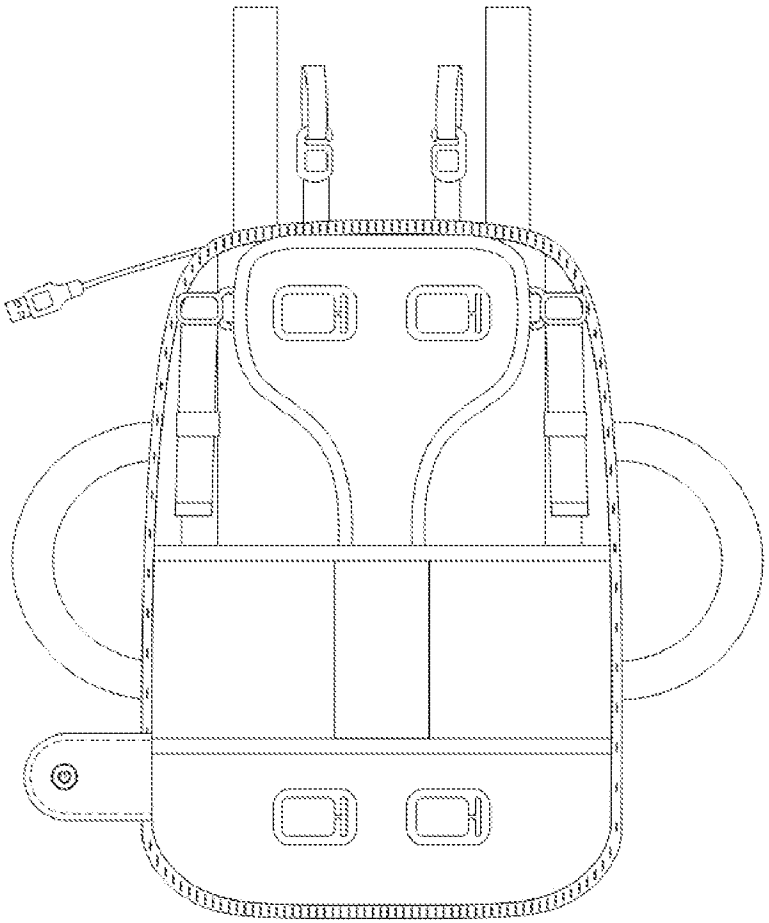
FIG. 29 depicts another example of the removable massage panel according to the present invention.
Figure 33:
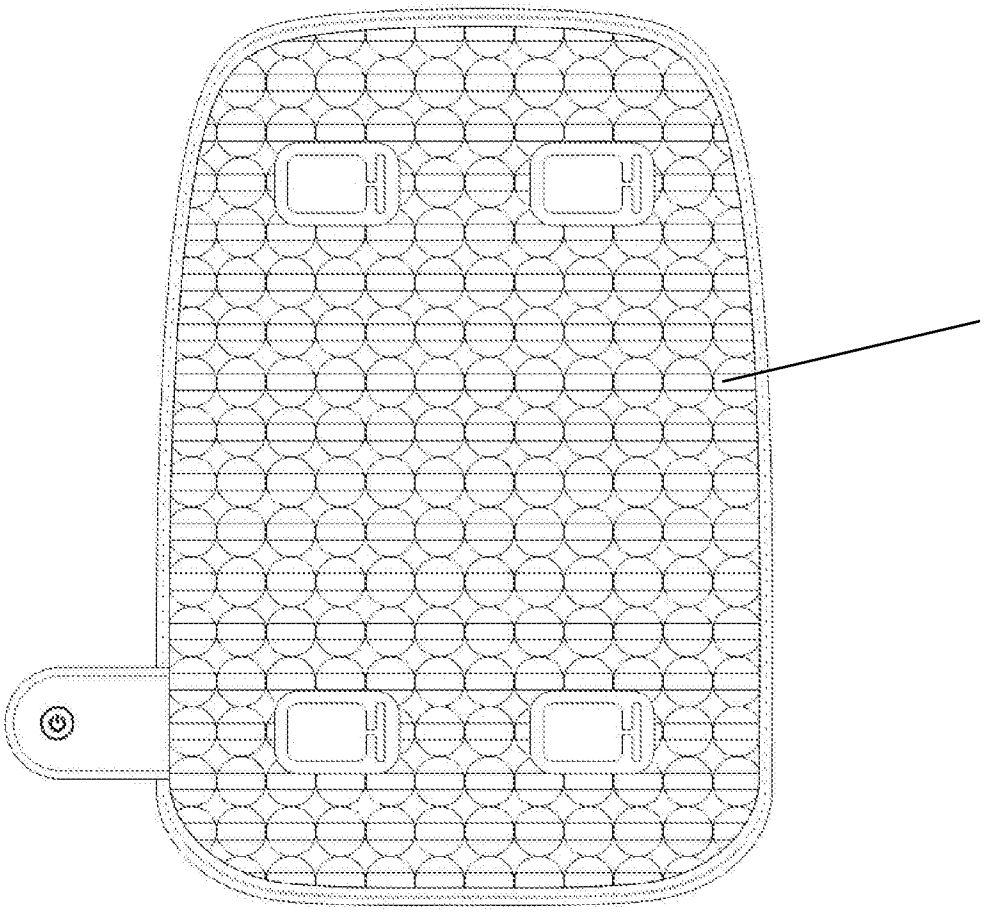
FIG. 33 depicts ergonomic accessories according to the present invention.

FIGS. 19 and 20 depict the removable massage panel has an adjustable band (200) for attaching the removable massage panel to a chair or for user to wear on their shoulder or waist or neck. FIGS. 25 and 26 depict another example of a removable massage panel (250) in which there may be an upper part (254) and a lower part (256) which may be adjusted relative to one another by an adjustable band (258). FIG. 26 shows the rear view of FIG. 25 and depicts adjustable straps (252) which may be used to attached the removed massage panel to a chair or any other suitable item or user's body. FIG. 27 depicts the outside of a removable massage panel and FIG. 28 the inside of the same removable massage panel. FIG. 27 depicts that there may be USB charger (270) and along the interior there may be a zipper pocket (272) for storage of a battery that may be charged.

Figure 21:
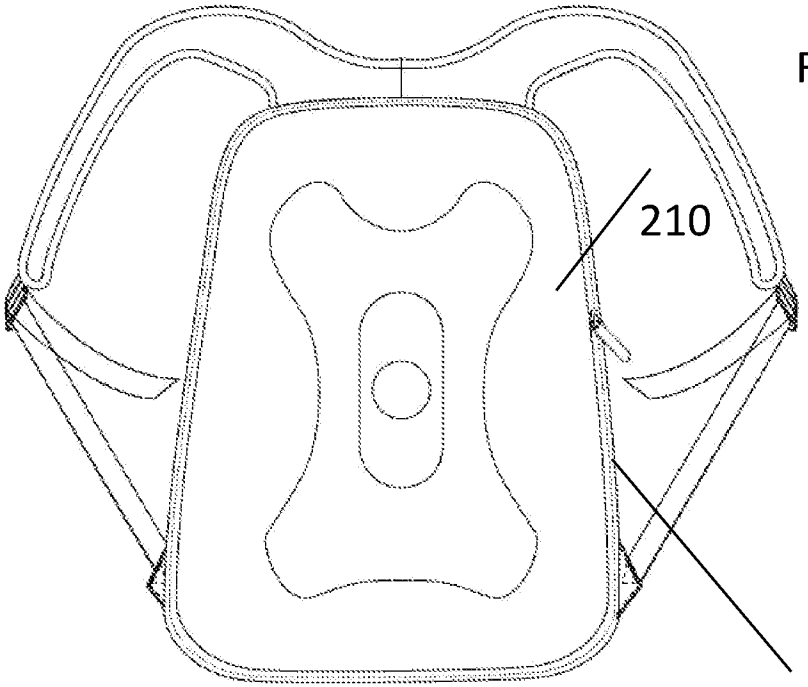
FIG. 21 depicts another example of the removable massage panel according to the present invention.
Figure 22:
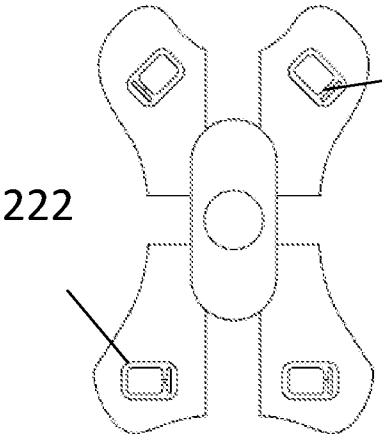
FIG. 22 depicts that the massage heads may be in different positions according to the present invention.

FIG. 21 depicts a removable massage panel (210) with shoulder straps. The removable massage panel is removably attached by a material selected from the group consisting of a zipper (212), buckle, magic band, hook and loop, button, snap and hook. FIG. 22 depicts the massage heads (220) on the removable panel are adjustable. For example, massage head (220) is rotated to be at an angle and massage head (222) is rotated to be sideways.

Figure 24:
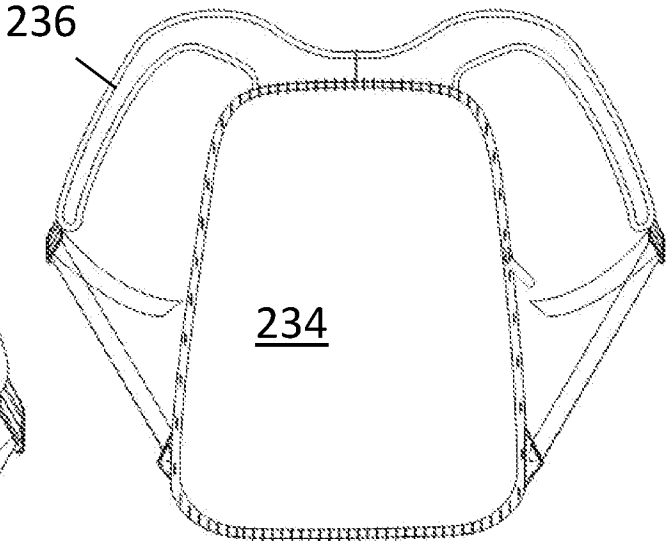
FIG. 24 depicts another example of the removable massage panel according to the present invention.
Figure 23:
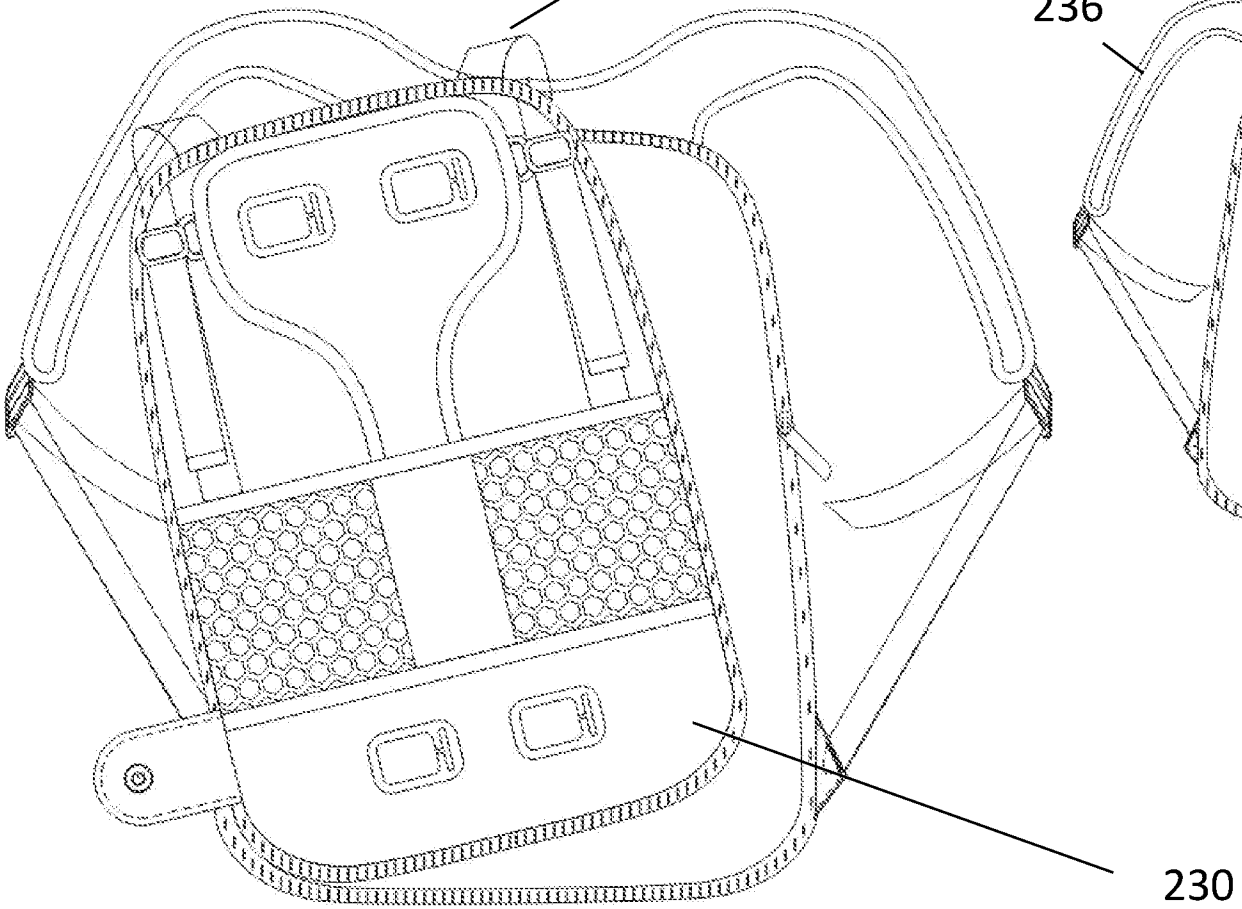
FIG. 23 depicts another example of the removable massage panel according to the present invention.

FIGS. 23 and 24 depict the removable massage panel (230) has an adjustable band and the bag body (234) retains the shoulder straps (236). FIG. 24 depicts the bag body with the removable massage panel removed.

FIGS. 30, 31, 32 and 33 depict the removable massage panel having an ergonomics accessory. The ergonomic accessory may be made of a material selected from a group consisting of latex, memory cotton, molded supporting board (302) with spring (300) and material conforming to ergonomic modeling. This may be, for example, a plastic support plate or three dimensional support mesh (304).

Figure 34:
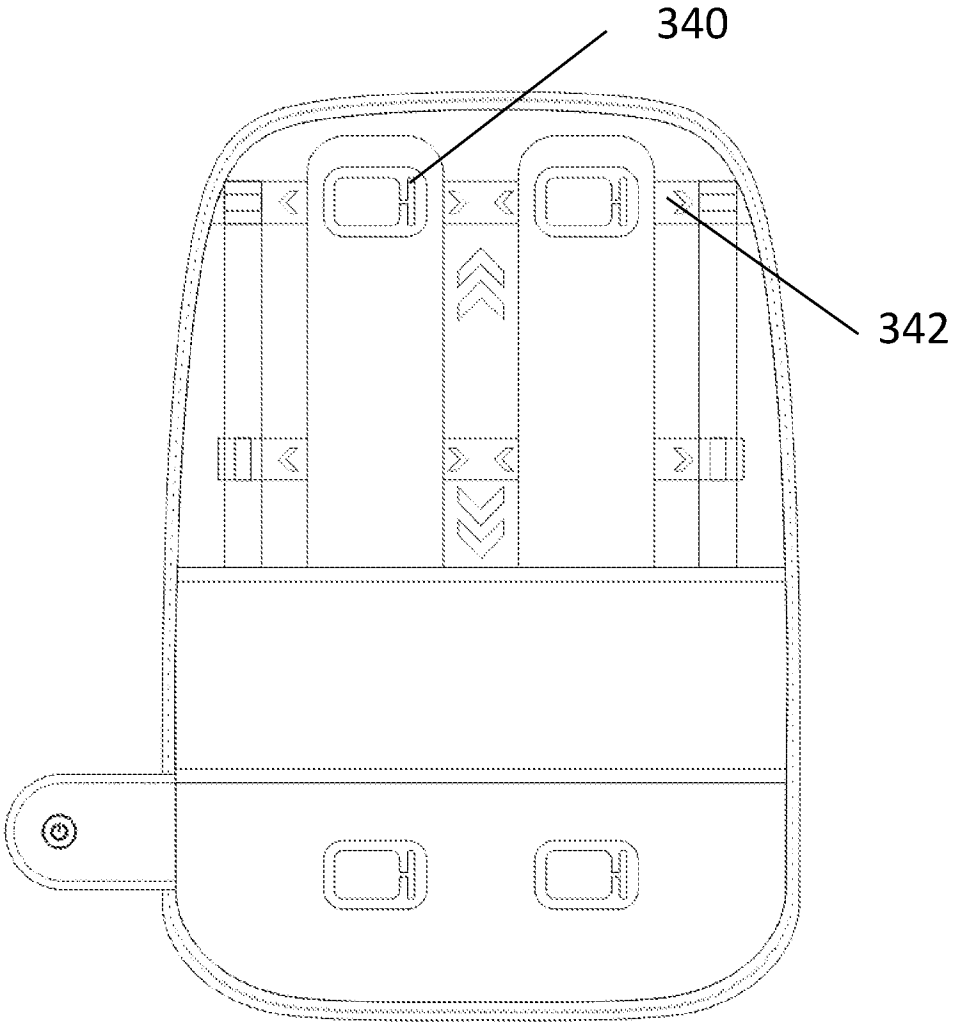
FIG. 34 depicts the massage heads are movable according to the present invention.
Figure 36:
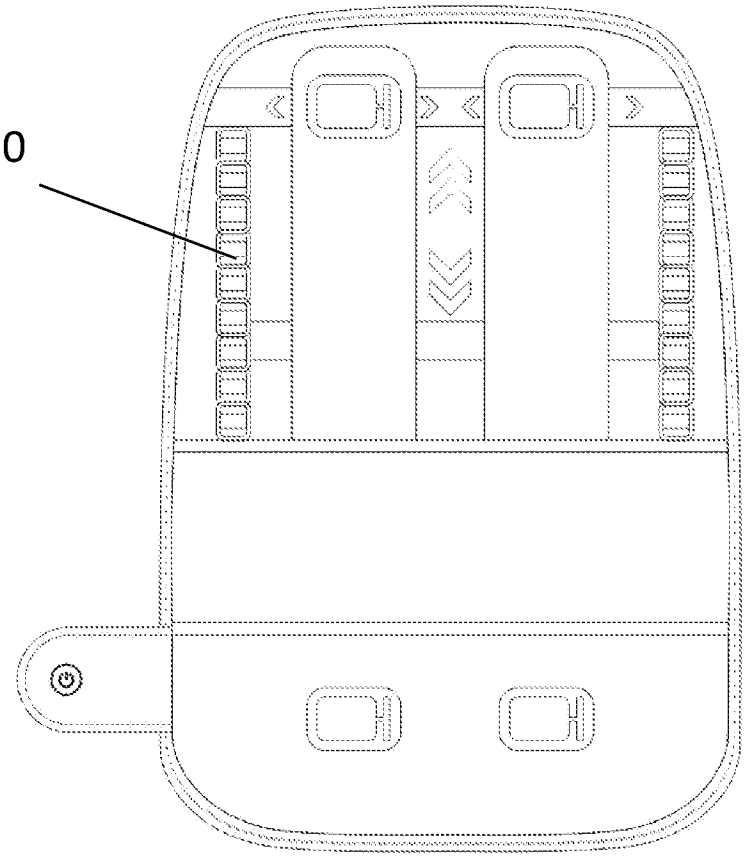
FIG. 36 depicts the massage heads may move along a track according to the present invention.
Figure 35:
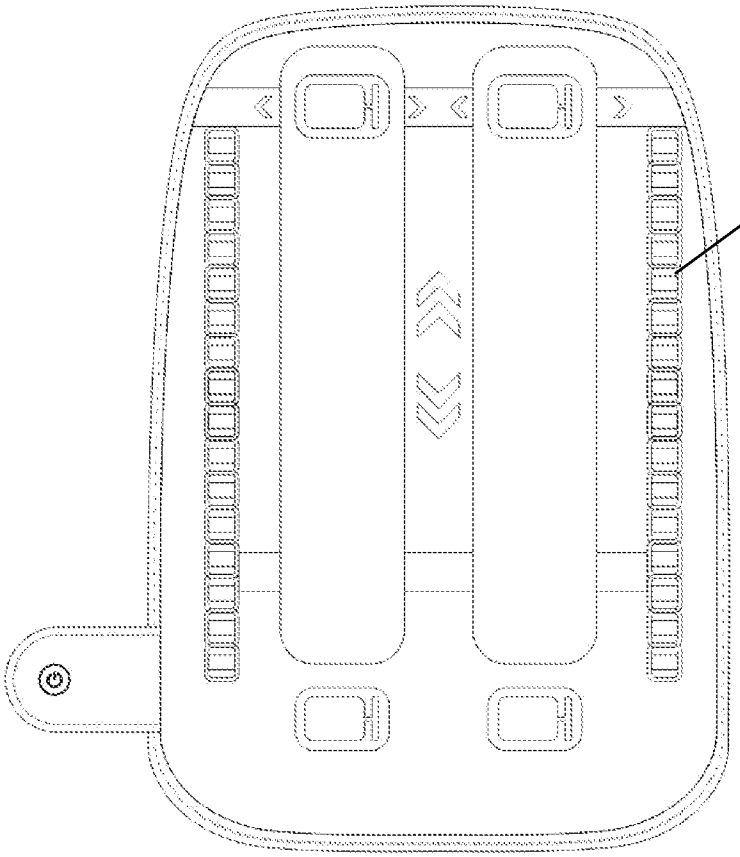
FIG. 35 depicts the massage heads may move along a track according to the present invention.
Figure 38:
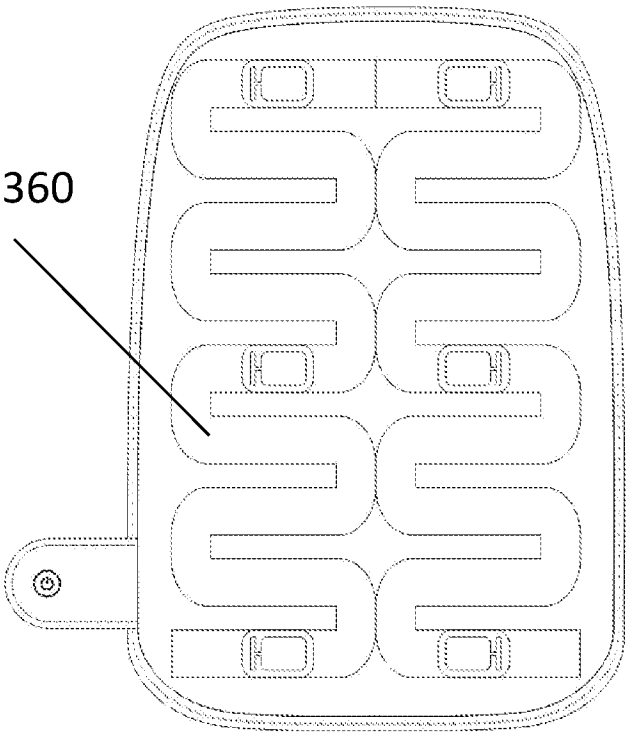
FIG. 38 depicts the massage heads may move along a track according to the present invention.
Figure 37:
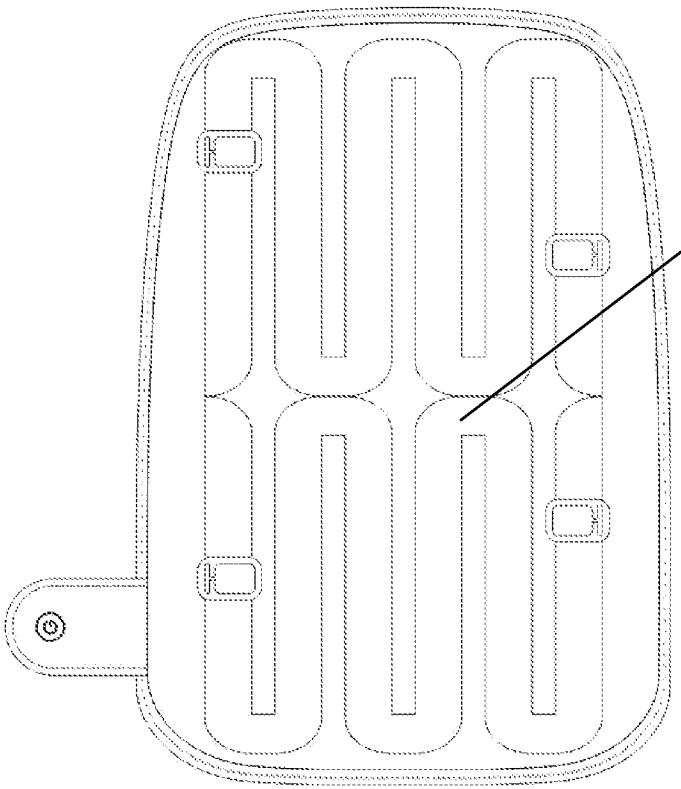
FIG. 37 depicts the massage heads may move along a track according to the present invention.
Figure 40:
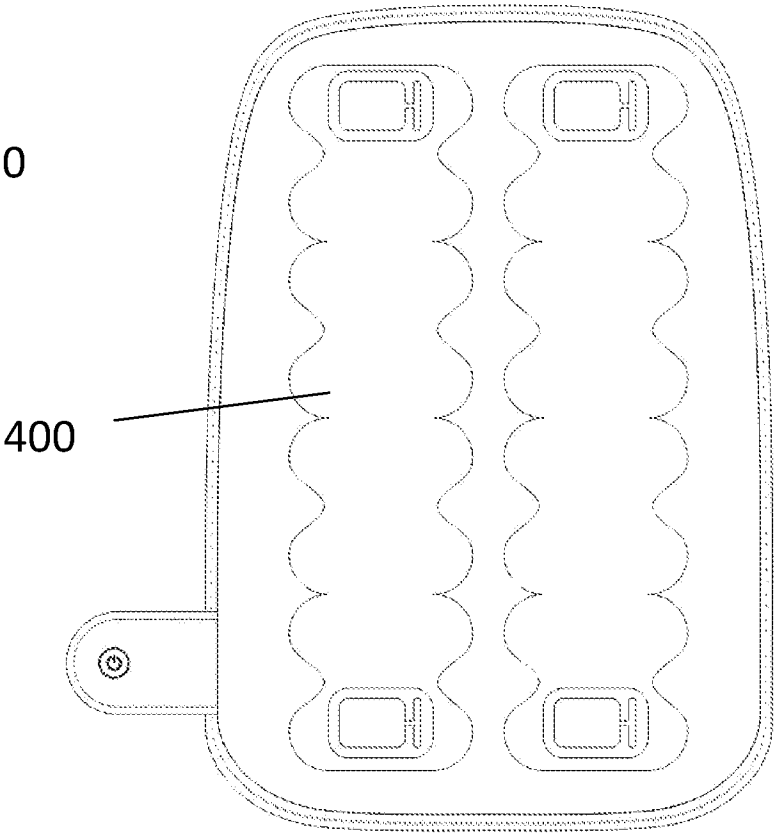
FIG. 40 depicts the massage heads may move along a track according to the present invention.
Figure 39:
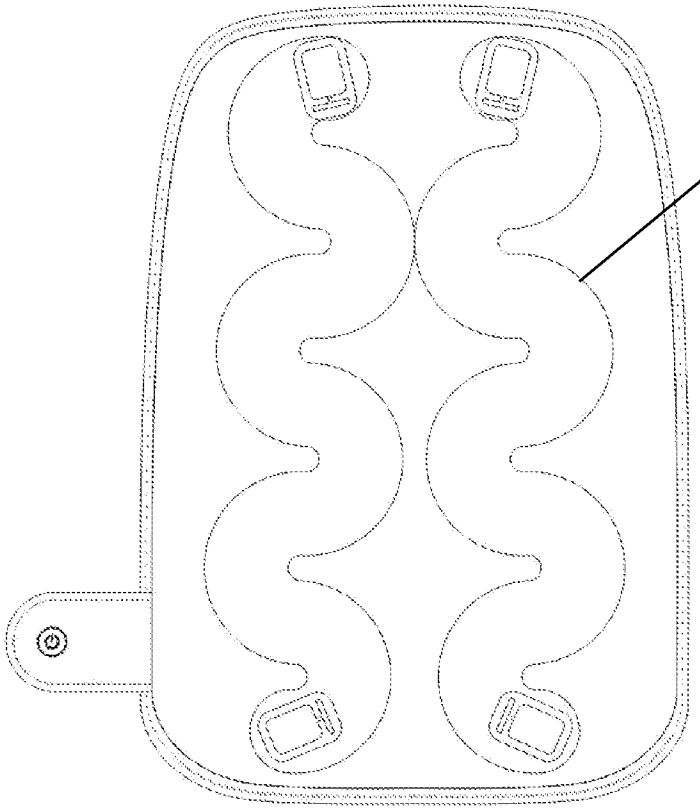
FIG. 39 depicts the massage heads may move along a track according to the present invention.
Figure 41:
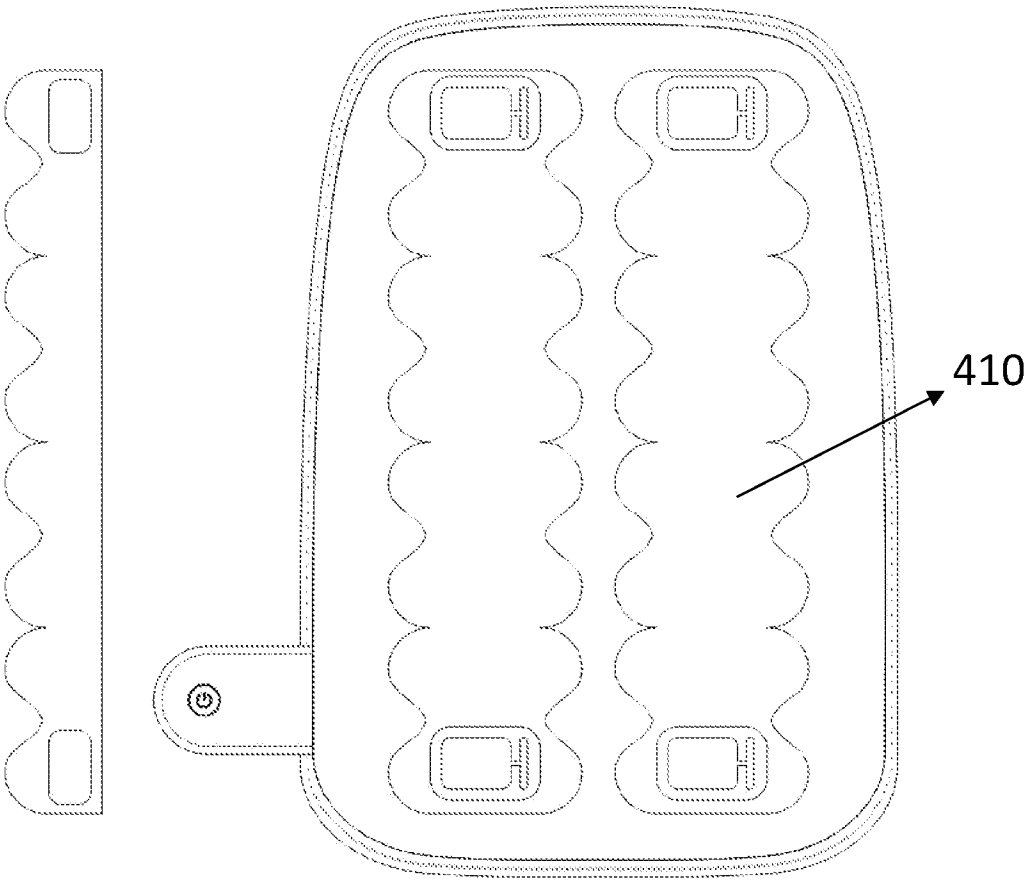
FIG. 41 depicts the massage heads may move along a track according to the present invention.

FIG. 34 depicts the adjustable massager head (340) is secured by a movable accessory (342). The movable accessory is a band with a buckle and the position of the massage apparatus corresponds to the buckle which is slid up and down along the band. FIGS. 35 and 36 depict the front and back of a removable massage panel having a track (350) to provide the massage head moves, wherein the track can be a bearing of shafts, pneumatic driven or motor-driven. FIGS. 37 and 38 similarly depict a front and back of a removable massage panel having a track (360) with a massage head. FIG. 39 similarly depicts a removable massage panel having a track (390) with a massage head. FIG. 40 similarly depicts a removable massage panel having a track (400) with a massage head. FIG. 41 similarly depicts a removable massage panel having a track (410) with a massage head.

Figure 42:
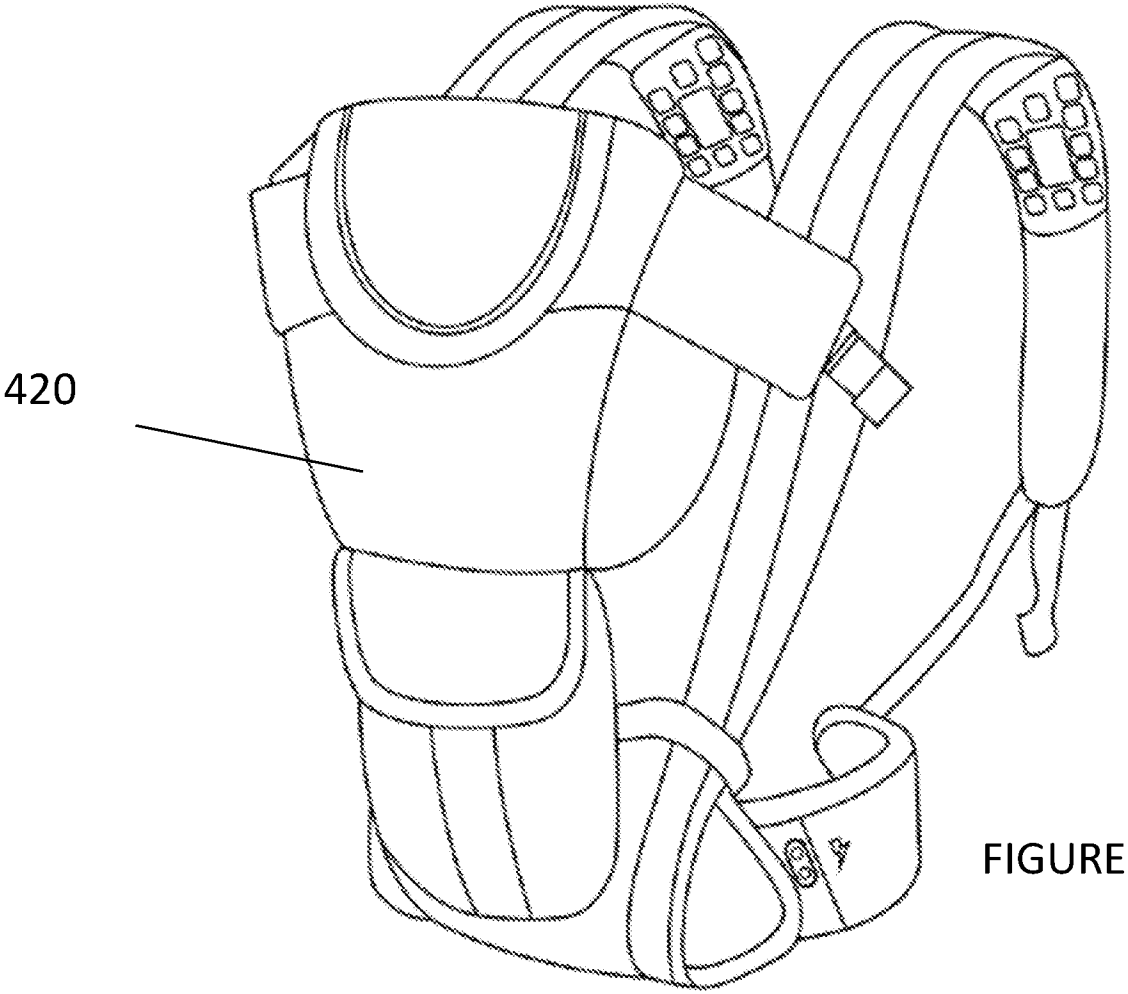
FIG. 42 depicts the present invention as a baby carrier.
Figure 43:
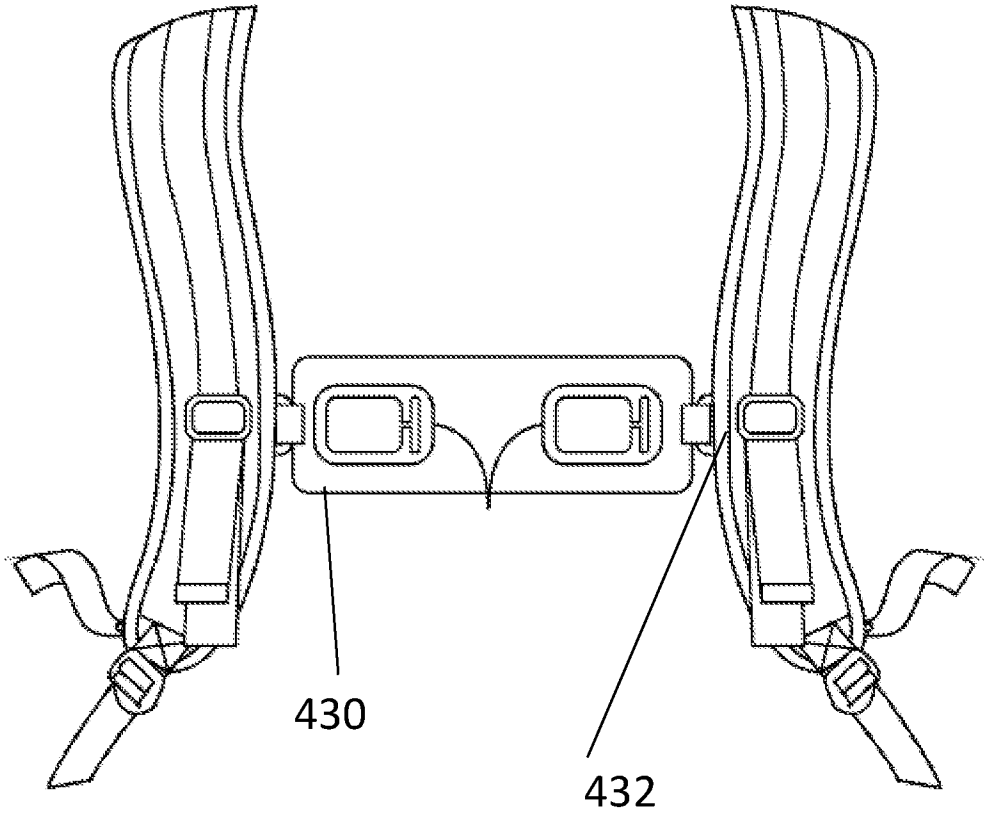
FIG. 43 depicts the present invention as a baby carrier.
Figure 44:
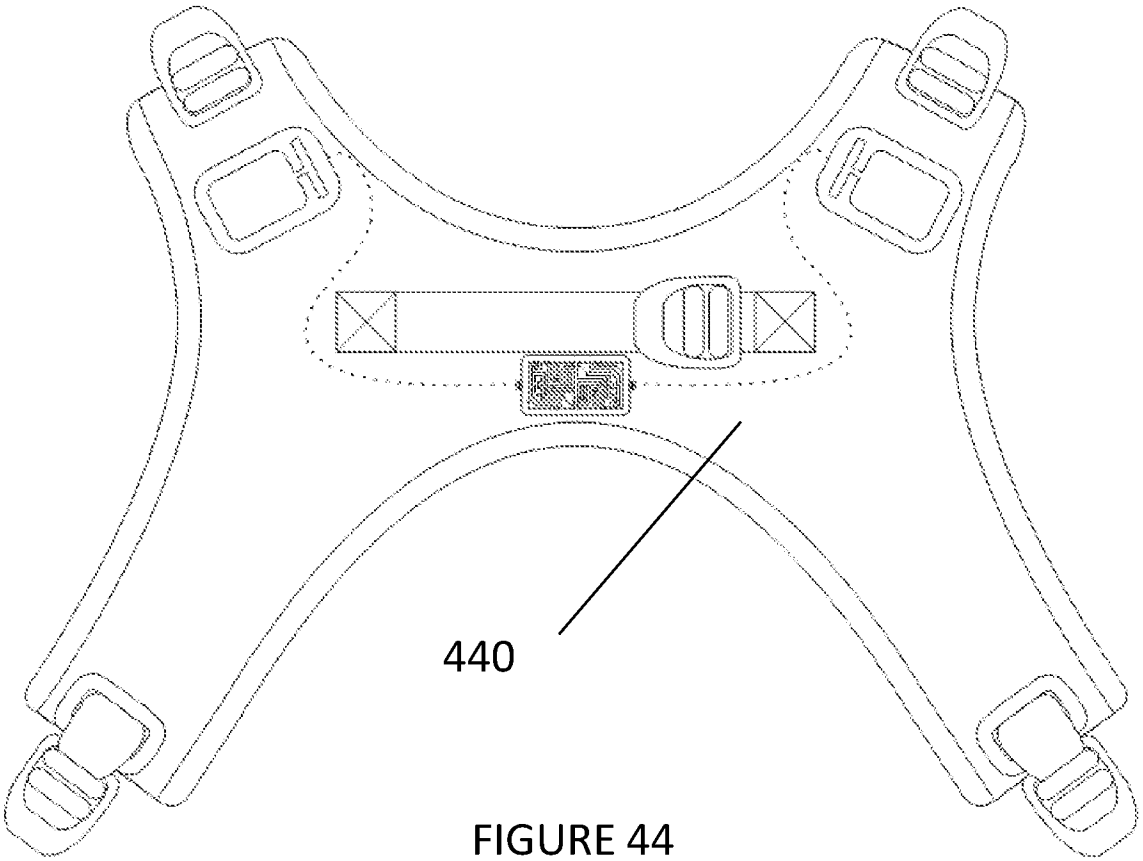
FIG. 44 depicts the present invention as a baby carrier.

FIGS. 42 and 43 depicts the body as a baby carrier (420). The removable massage panel (430) is attached to the shoulder straps (432). FIG. 44 depicts another example of the removable massage panel (440) that is attached to the shoulder straps as in a baby carrier embodiment.

There are many advantages to the present invention. It could help to be more convenient for a consumer to use the massage panel separately, they do not need to always carry the backpack, which may be heavy. And it can be put on chair, as a back, customers can use it when sitting on a chair. It is also easy for customer service, in case of any quality issue or any updates, customer do not need to send back both. And could also be able to buy one part only, not necessary to buy both bags and massage panel.

I claim:

1. A backpack, bag, baby carrier with a massage panel, comprising:

a body and a back panel with at least one shoulder strap, wherein the back panel has an upper portion with a top part and a portion of the top edge of the top part is connected to the shoulder strap, a bottom area of the top part is connected to the back panel of the body, wherein the top part has at least one massager apparatus, wherein the top part is a substantially rigid material that is at least 1 mm thick, wherein the massager apparatus has at least one massage head that is covered by a foam material, wherein the massage head further comprises a protective cover to cover the massage head when the massage is not operating, wherein the protective cover can be turned and attached to another position of the body.

2. A backpack, bag, baby carrier with massage panel as in claim 1, wherein the back panel of the body has a lower portion with at least one massage head that is fixed on a lower part of the back panel of the body.

3. A backpack, bag, baby carrier with massage panel as in claim 2, wherein the lower part is removably attached to the lower portion of the back panel of the body.

4. A backpack, bag, baby carrier with massage panel as in claim 3, wherein the lower part is removably attached by a material selected from the group consisting of a zipper, buckle, magic band, hook and loop, button, snap and hook.

5. A backpack, bag, baby carrier with massage panel as in claim 1, wherein the top part is removably attached to the upper portion of the back panel of the body.

6. A backpack, bag, baby carrier with massage panel as in claim 1, wherein the adjustable band is fixed on the bottom portion of the top part and the lower part and have at least one detachable accessory, wherein the detachable accessory is selected from the group consisting of webbing, ribbon, zipper, buckle, magic band, hook and loop, button, snap and hook.

7. A backpack, bag, baby carrier with massage panel as in claim 1, wherein the massage head further comprises a protective cover to cover the massage head when the massage is not operating.

8. A backpack, bag, baby carrier with massage panel as in claim 7, wherein a removable component further comprises a pocket.

9. A backpack, bag, baby carrier with massage panel as in claim 1, further comprising a control circuit and a function control board for controlling the massage apparatus.

10. A backpack, bag, baby carrier with massage panel as in claim 9, wherein the function control board can be a wired solid board, or a wireless connection controller.

11. A backpack, bag, baby carrier with massage panel as in claim 1, wherein the backpack panel of the body has an opening.

12. A backpack, bag, baby carrier with massage panel as in claim 1, further comprising a pocket on a portion of the body storing a battery.

13. A backpack, bag, baby carrier with a massage panel, comprising:

a body and a back panel with at least one shoulder strap, wherein the back panel has an upper portion with a top part and a portion of the top edge of the top part is connected to the shoulder strap, a bottom area of the top part is connected to the back panel of the body, wherein the top part has at least one massager apparatus, a control circuit and a function control board for controlling the massage apparatus, wherein the top part is a substantially rigid material that is at least 1 mm thick, wherein the massager apparatus has at least one massage head that is covered by a foam material, wherein the massage apparatus has at least two cables, wherein each of the cables has at least one fast connector on at least one of the cables connecting the massage head and the control circuit, the massage head and the battery, the control circuit and the battery and the control circuit and function control board.

14. A backpack, bag, or baby carrier with a removable massage panel, comprising:

a body, at least one shoulder strap and a removable panel with at least one massage apparatus on it, wherein the removable panel is at least 1 mm thick of substantially rigid material, wherein the massager apparatus has at least one massage head which is covered by a foam cover, wherein the removable panel has an adjustable band for a user to wear the removable massage panel, wherein the massage apparatus further comprises at least two cables, wherein each of the cables has at least one fast connectors on at least one of the cable connecting the massage head and the control circuit, the massage head and the battery, the control circuit and the battery and the control circuit and function control board.

15. A backpack, bag, baby carrier with removable massage panel as in claim 14, wherein the removable panel has an adjustable band to attach the removable panel to a chair.

16. A backpack, bag, baby carrier with removable massage panel as in claim 14, wherein the removable panel has an adjustable band for a user to wear the removable massage panel.

17. A backpack, bag or baby carrier with removable massage panel as in claim 16, wherein the removable massage panel is further comprising a ergonomics accessory.

18. A backpack, bag, or baby carrier with removable massage panel as in claim 17, wherein the ergonomic accessory is made of a material selected from a group consisting of Latex, memory cotton, molded supporting board with spring and material conforming to ergonomic modeling.

19. A backpack, bag or baby carrier with removable massage panel as in claim 16, wherein a pocket contained on a portion of the removable massage panel stores a battery.

20. A backpack, bag or baby carrier with removable massage panel as in claim 16, further comprising a control circuit and a function control board for controlling the massage apparatus.

21. A backpack, bag or baby carrier with removable massage panel as in claim 16, wherein a backpack panel of the body comprise an opening.

22. A backpack, bag or baby carrier with removable massage panel as in claim 14, wherein the massage head on the removable panel is adjustable.

23. A backpack, bag, baby carrier with removable massage panel as in claim 14, wherein the removable massage panel is removably attached by a material selected from the group consisting of a zipper, buckle, magic band, hook and loop, button, snap and hook.

24. A backpack, bag, or baby carrier with a removable massage panel, comprising:

a body, at least one shoulder strap and a removable panel with at least one massage apparatus on it, wherein the removable panel is at least 1 mm thick of substantially rigid material, wherein the massager apparatus has at least one massage head which is covered by a foam cover, wherein the massage head on the removable panel is adjustable, wherein the adjustable massager head is secured by a movable accessory.

25. A backpack, bag or baby carrier with removable massage panel as in claim 24, wherein the movable accessory is a band with a buckle and the position of the massage apparatus corresponds to the buckle which is slid up and down along the band.

26. A backpack, bag, or baby carrier with a removable massage panel, comprising:

a body, at least one shoulder strap and a removable panel with at least one massage apparatus on it, wherein the removable panel is at least 1 mm thick of substantially rigid material, wherein the massager apparatus has at least one massage head which is covered by a foam cover, wherein the removable panel has an adjustable band for a user to wear the removable massage panel, further comprising a track to provide the massage head moves, wherein the track can be a bearing of shafts, pneumatic driven or motor-driven.

27. A backpack, bag, or baby carrier with a removable massage panel, comprising:

a body, at least one shoulder strap and a removable panel with at least one massage apparatus on it, wherein the removable panel is at least 1 mm thick of substantially rigid material, wherein the massager apparatus has at least one massage head which is covered by a foam cover, wherein the removable panel has an adjustable band for a user to wear the removable massage panel, wherein the removable panel has a top part and a lower part and there is an adjustable band on a bottom edge of the top part of the removable panel to connect to the lower part.

* * * * *